US010948862B2

(12) United States Patent
Ohzawa

(10) Patent No.: US 10,948,862 B2
(45) Date of Patent: Mar. 16, 2021

(54) RECORDING MATERIAL CHARACTERISTIC DETECTING DEVICE AND IMAGE FORMING DEVICE

(71) Applicant: KONICA MINOLTA, INC., Tokyo (JP)

(72) Inventor: Satoko Ohzawa, Toyokawa (JP)

(73) Assignee: Konica Minolta, Inc., Chiyoda (JP)

( * ) Notice: Subject to any disclaimer, the term of this patent is extended or adjusted under 35 U.S.C. 154(b) by 0 days.

(21) Appl. No.: 16/525,922

(22) Filed: Jul. 30, 2019

(65) Prior Publication Data

US 2020/0057406 A1 Feb. 20, 2020

(30) Foreign Application Priority Data

Aug. 20, 2018 (JP) ..... JP2018-154047

(51) Int. Cl.
*G03G 15/00* (2006.01)
*G03G 15/20* (2006.01)

(52) U.S. Cl.
CPC ..... *G03G 15/5029* (2013.01); *G03G 15/2039* (2013.01); *G03G 2215/00616* (2013.01); *G03G 2215/00738* (2013.01); *G03G 2215/00751* (2013.01)

(58) Field of Classification Search
CPC ..... G03G 15/5029; G03G 15/6588; G03G 15/6591; G03G 2215/00611; G03G 2215/00616; G03G 2215/0062; G03G 2215/00742; G03G 2215/00751; G03G 2215/00738; G01B 11/0633; G01N 21/86
USPC ..... 399/45, 389
See application file for complete search history.

(56) References Cited

U.S. PATENT DOCUMENTS 3,932,755 A * 1/1976 Sagawa ..... B65H 7/125 250/349
2005/0078973 A1 4/2005 Suzuki
2007/0286664 A1 12/2007 Takashima
(Continued)

FOREIGN PATENT DOCUMENTS

JP 62079149 A * 4/1987
JP 02081846 A * 3/1990
JP 02305744 A * 12/1990 ..... G03G 15/50
(Continued)

*Primary Examiner* — Robert B Beatty
(74) *Attorney, Agent, or Firm* — Buchanan Ingersoll & Rooney PC

(57) ABSTRACT

A recording material characteristic detecting device that irradiates a first light and a second light to a recording material carried along a predetermined carrying path and detects a transmitted light generated when the first light transmits the recording material and a reflection light generated when the second light is reflected by the recording material, and detects a characteristic of the recording material, comprises: a reflection light source that irradiates the second light toward the carrying path; a reference plate for reflection light arranged oppositely to the reflection light source across the carrying path to reflect the second light; and a light detector arranged oppositely to the reference plate for reflection light across the carrying path to detect at least a reflection light generated in response to reflection of the second light. The reference plate has a higher reflectivity to the second light than a reflectivity to the first light.

15 Claims, 14 Drawing Sheets

(56) References Cited

U.S. PATENT DOCUMENTS

| | | | | |
|---|---|---|---|---|
| 2018/0314199 | A1* | 11/2018 | Matsuda | G03G 15/5029 |
| 2019/0235435 | A1* | 8/2019 | Yamamura | G03G 15/6591 |

FOREIGN PATENT DOCUMENTS

| | | | | |
|---|---|---|---|---|
| JP | 2003137457 | A | | 5/2003 |
| JP | 2005070508 | A | | 3/2005 |
| JP | 2006264833 | A | * | 10/2006 |
| JP | 2007326669 | A | | 12/2007 |
| JP | 2019105710 | A | * | 6/2019 |

* cited by examiner

RECORDING MATERIAL CHARACTERISTIC DETECTING DEVICE AND IMAGE FORMING DEVICE

Japanese patent application No. 2018-154047 filed on Aug. 20, 2018 including description, claims, drawings, and abstract the entire disclosure is incorporated herein by reference in its entirety.

BACKGROUND

Technological Field

The present invention relates to a recording material characteristic detecting device and an image forming device using the recording material characteristic detecting device. The present invention more specifically relates to a technique for detecting a characteristic of a sheet type recording material such as a print paper.

Description of the Related Art

Image forming devices such as printers or MFPs (Multifunction Peripherals) feed sheet type recording materials such as print papers and transfer images such as toner images on the recording materials. The image forming devices then apply fixing processing to the recording materials so that the images are fixed to the recording materials and the recording materials are output. The recording materials used by the image forming devices are of great variety. The recording materials include thin papers, thick papers, plain papers, recycled papers, coated papers and OHP films.

A carrying speed of the recording material has an optimum speed depending on the characteristics of the recording materials. When the carrying speed is lower than the optimum speed, throughput at the time of forming an image is reduced. When the carrying speed is higher than the optimum speed, jams (paper jams) are likely to happen in carrying of the recording material. Also, fixing temperature for fixing processing has an optimum temperature depending on the characteristics of the recording materials. When, for example, the recording material is the thick paper, the optimum temperature is high, and when the recording material is the thin paper, the optimum temperature is low. It, hence, is preferable for the image forming device to set the carrying speed and/or the fixing temperature to the optimum value in accordance with the characteristic of the used recording material.

In order to automatically determine the characteristic of the recording material, an image forming device that includes a light emitting element, a transmitted light receiving element, and a reflection light receiving element in a carrying path of the recording material is known. This known technique is introduced for example in Japanese Patent Application Laid-Open No. JP 2005-70508 A. According to the known technique, when the recording material reaches a predetermined position, the image forming device enables the light emitting element to irradiate the recording material with light, and the transmitted light receiving element to detect a transmitted light that transmits the recording material. The image forming device then enables the reflection light receiving element to detect a reflection light reflected from the recording material so that the image forming device measures a transmittance and a reflectivity of the recording material, and detects the characteristic of the recording material. According to the known technique, the image forming device is capable of automatically detecting the characteristic of the recording material as which is being carried, and setting the carrying speed and/or the fixing temperature at the optimum value.

The carrying path of the recording material according to the known technique is provided with the light emitting element, the transmitted light receiving element, and the reflection light receiving element. When the carrying path of the recording material is provided with the light emitting element, the transmitted light receiving element, and the reflection light receiving element, stains such as paper powder are deposited, and an amount of the light received by the transmitted light receiving element and/or the reflection light receiving element changes depending on time. The accurate transmittance and reflectivity of the recording material cannot be obtained only by irradiating with light when the recording material reaches the predetermined position and measuring the transmitted light and the reflection light. In order to reduce an effect of the time-dependent change, it is preferable to turn on the light emitting element without having the positioned recording material and measure the amount of the light received by each of the transmitted light receiving element and the reflection light receiving element prior to the measurement of the transmitted light and the reflection light by irradiating the recording material with light.

When turning on the light emitting element without having the positioned recording material, there is no object that reflects a light in the carrying path. The reflection light receiving element, therefore, does not receive the reflection light. A reflection board facing the light emitting element needs to be provided across the carrying path of the recording material. The reflection board reflects the light. A board with a mirror surface, for instance or with a white surface that has a predetermined reflectivity on its surface is used as the reflection board. The reflection board is provided oppositely to the light emitting element so that the reflection board reflects the light even when the light emitting element is turned on without the recording material positioned in the carrying path. The reflection light receiving element, thus, is enabled to receive the reflection light.

FIGS. 14A, 14B and 14C illustrate an exemplary structure of the conventional image forming device having the reflection board. As illustrated in FIG. 14A, a light emitting element 102, for example, is arranged near a carrying path 101 and a transmitted light receiving element 103 is arranged oppositely to the light emitting element 102 across the carrying path 101. A reflection light receiving element 104 is arranged oppositely to the transmitted light receiving element 103. A reflection board 105 is arranged oppositely to the light emitting element 102 and the reflection light receiving element 104 across the carrying path 101.

With this structure, when the light emitting element 102 is turned on without the recording material positioned on the carrying path 101 as illustrated in FIG. 14B, the transmitted light receiving element 103 directly receives an irradiation light 110 of the light emitting element 102, and the reflection light receiving element 104 receives a reflection light 120 reflected from the reflection board 105.

When the light emitting element 102 is turned on with a recording material 109 positioned on the carrying path 101 as illustrated in FIG. 14C, the transmitted light receiving element 103 receives a transmitted light 111 that transmits the recording material 109, and the reflection light receiving element 104 receives a reflection light 121 reflected from a surface of the recording material 109.

The light received by the transmitted light receiving element 103 is not only the transmitted light 111 but also an irregular reflection light 112 generated between the recording material 109 and the reflection board 105 after transmitting the recording material 109. By applying the aforementioned structure, an amount of the transmitted light received by the transmitted light receiving element 103 varies due to the effect of the irregular reflection light 112, and the transmittance of the recording material 109 cannot be measured accurately. Especially when the measurement is performed with carrying the recording material 109, the measured value is greatly varied because of displacement of the recording material 109, for instance, and the characteristic of the recording material cannot be determined.

SUMMARY

The present invention is intended to solve the above problems. Thus, the present invention is intended to provide a recording material characteristic detecting device and an image forming device using the recording material characteristic detecting device that reduce an effect caused by an irregular reflection light generated between a recording material and a reflection board and detect the accurate characteristic of the recording material.

First, the present invention is directed to a recording material characteristic detecting device that irradiates a first light and a second light to a sheet type recording material carried along a predetermined carrying path and detects a transmitted light generated when the first light transmits the recording material and a reflection light generated when the second light is reflected by the recording material.

To achieve at least one of the abovementioned objects, according to an aspect of the present invention, the recording material characteristic detecting device reflecting one aspect of the present invention comprises: a reflection light source that irradiates the second light toward the carrying path; a reference plate for reflection light arranged oppositely to the reflection light source across the carrying path to reflect the second light; and a light detector arranged oppositely to the reference plate for reflection light across the carrying path to detect at least a reflection light generated in response to reflection of the second light. The reference plate for reflection light has a higher reflectivity to the second light than a reflectivity to the first light.

Second, the present invention is directed to an image forming device that carries a sheet type recording material along a predetermined carrying path and forms an image on the recording material.

To achieve at least one of the abovementioned objects, according to an aspect of the present invention, the image forming device reflecting one aspect of the present invention comprises: a recording material characteristic detecting device according to claim 1, which is arranged in the carrying path; and a controller that controls operations to form the image on the recording material based on the characteristic of the recording material detected by the recording material characteristic detecting device.

BRIEF DESCRIPTION OF THE DRAWING

The advantages and features provided by one or more embodiments of the invention will become more fully understood from the detailed description given herein below and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Preferred Embodiment

Figure 1:
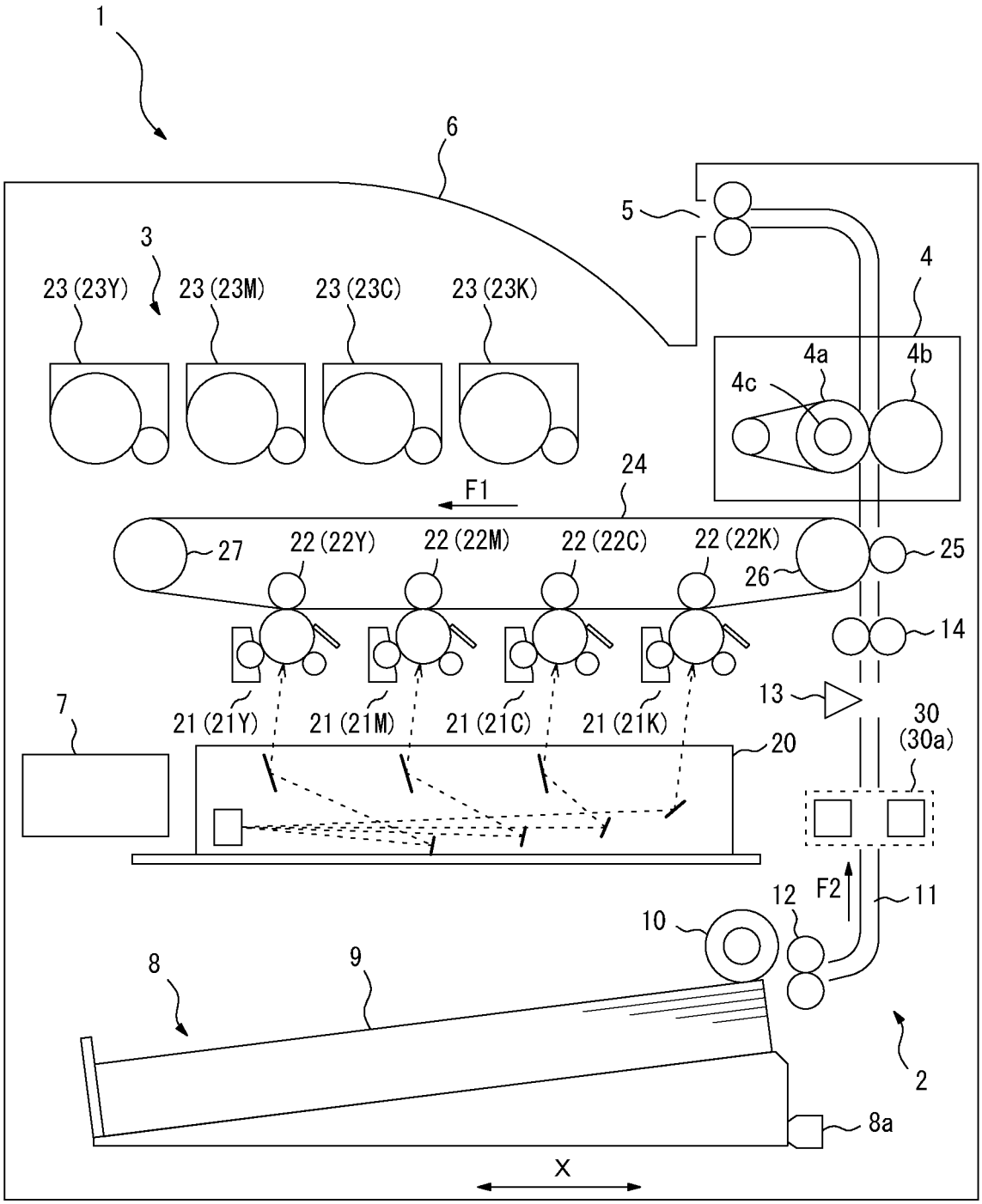
FIG. 1 illustrates an exemplary conceptual configuration of an image forming device.

FIG. 1 illustrates an exemplary conceptual configuration of an image forming device 1 in which the first preferred embodiment of the present invention may be practiced. The image forming device 1 of FIG. 1 is a printer capable of forming color images in tandem system. The image forming device 1 includes a paper feeding unit 2, an image forming unit 3 and a fixing unit 4. The image forming device 1 forms a color image or a black and white image on a sheet type recording material 9 such as a print paper, and delivers the recording material 9 on a paper delivery tray 6 from a paper delivery port 5 provided in an upper part of a device body. The image forming device 1 includes a controller 7 inside the device body. The controller 7 controls operations of each part such as the paper feeding unit 2, the image forming unit 3 and the fixing unit 4.

The paper feeding unit 2 includes a paper feeding cassette 8, a paper feeding cassette switching sensor 8*a*, a pick up roller 10, a carrying path 11, a separation roller 12, a leading end detecting sensor 13, a resist roller 14, a secondary transfer roller 25 and a recording material characteristic detecting device 30.

The paper feeding cassette 8 is a container in which a bundle of the sheet type recording materials 9 such as the print papers are stored. The paper feeding cassette 8 can be sled in X direction in FIG. 1, for instance. The paper feeding cassette 8 is opened by pulling out from a lower part of the device body of the image forming device 1, or closed by pushing into the lower part of the device body. When the recording materials 9 stored in the paper feeding cassette 8 get into an empty condition, for example, the user pulls out the paper feeding cassette 8 from the lower part of the device body so that he or she may supply the recording materials 9. The recording materials 9 storable in the paper feeding cassette 8 are of great variety. The recording materials 9 include thin papers, thick papers, plain papers, recycled papers, coated papers and OHP films, for instance. The paper feeding cassette switching sensor 8*a* is arranged near the paper feeding cassette 8. The paper feeding cassette switching sensor 8*a* detects opening and closing of the paper feeding cassette 8.

The carrying path 11 is a path to carry the recording material 9 in an arrow F2 direction when the image forming device 1 forms an image on the recording material 9. The recording material 9 is carried along the carrying path 11 illustrated in FIG. 1 in the arrow F2 direction so that the image such as a toner image is transferred to a surface of the recording material 9 and the image is fixed. The recording material 9 is then delivered from the delivery port 5. The carrying path 11 of FIG. 1 shows a carrying path for forming an image only on a surface of the recording material 9. However, this is given not for limitation. To be more specific, the carrying path 11 may further includes a recording material inversion path for forming an image on a back of the recording material 9.

The pick-up roller 10 takes the recording material 9 from an upper part of the bundle of the recording materials 9 stored in the paper feeding cassette 8, and carries to the carrying path 11. The pick-up roller 11 is in contact with a single sheet of the recording material 9 which is placed on a top of the bundle of the recording materials 9, and feeds the single recording material 9 to the downstream. When the single recording material 9 which is placed on the top is fed, the second recording material 9 which follows the recording material 9 on the top may be fed toward the downstream together with the recording material 9 on the top. The separation roller 12 controls that the recording material 9 after the second sheet which is fed together with the recording material 9 on the top not to be led to the downstream of the carrying path 11. The separation roller 12 only leads the recording material 9 on the top to the downstream. In the downstream side of the separation roller 12, the recording material 9 is carried one after another along the carrying path 11.

The leading end detecting sensor 13 is a sensor that detects a leading end of the recording material 9 carried on the carrying path 11. The resist roller 14 holds the leading end of the recording material 9 detected by the leading end detecting sensor 13, and feeds the recording material 9 to the secondary transfer roller 25 at a timing synchronized with the image forming operation by the image forming unit 3. The toner image primarily transferred to an intermediate belt 24 is secondarily transferred to the recording material 9 fed by the resist roller 14 when the recording material 9 passes through the secondary transfer roller 25. The paper feeding unit 2 leads the recording material 9 to which the toner image is transferred to the fixing unit 4.

The paper feeding unit 2 is enabled to adjust a carrying speed to carry the recording material 9 along the carrying path 11. To be more specific, the image forming device 1 of the first preferred embodiment is configured to adjust the carrying speed as required in accordance with the characteristic of the recording material 9 carried along the carrying path 11.

The recording material characteristic detecting device 30 includes a sensor unit 30*a* arranged at a predetermined position between the separation roller 12 and the resist roller 14 on the carrying path 11. The recording material characteristic detecting device 30 detects the characteristic of the recording material 9 carried on the carrying path 11. The recording material characteristic detecting device 30 uses at least two types of lights to detect the characteristic of the recording material 9. After the characteristic of the recording material 9 is detected by the recording material characteristic detecting device 30, the carrying speed of the recording material 9 is adjusted in accordance with the detected characteristic. Besides the carrying speed, a value such as a parameter for fixing operations by the fixing unit 4 is adjusted in accordance with the characteristic detected by the recording material characteristic detecting device 30. The detail of the recording material characteristic detecting device 30 is explained later.

The image forming unit 3 forms toner images of four colors, Y (yellow), M (magenta), C (cyan) and K (black), and transfers the toner images of the four colors at the same time to the recording material 9 passing through the position of the secondary transfer roller 25. The image forming unit 3 includes an exposure unit 20, a developing unit 21, a primary transfer roller 22, the intermediate belt 24 and toner bottles 23 of the respective colors. The developing unit 21 is provided for the toner of each color. The primary transfer roller 22 is provided corresponding to each developing unit 21. Four developing units 21Y, 21M, 21C and 21K are provided in a lower position of the intermediate belt 24. Each of toner bottles 23Y, 23M, 23C and 23K supplies the toner of each color to the corresponding developing unit 21Y, 21M, 21C or 21K.

The exposure unit 20 exposures an image carrier (a photoreceptor drum) provided with each developing unit 21Y, 21M, 21C and 21K, and forms a latent image to the image carrier of each developing unit 21Y, 21M, 21C and 21K. Each developing unit 21Y, 21M, 21C and 21K develops the latent image with the toner so that the toner image is formed on a surface of the image carrier. Each developing unit 21Y, 21M, 21C and 21K then superposes the toner image of each color one after another on the intermediate belt 24 which is circulated and moved in an arrow direction F1 to enable primary transfer. When the intermediate belt 24 passes through the position of the developing unit 21K which is at the downstream end, a color image which is superposing the toner images of four colors is formed on the surface of the intermediate belt 24. The toner image formed on the intermediate belt 24 is in contact with the recording material 9 carried by the paper feeding unit 2 and secondarily transferred on the surface of the recording material 9 when passing through a position faces to the secondary transfer roller 25.

The fixing unit 4 includes a heating roller 4*a* and a pressure roller 4*b*. The fixing unit 4 enables the recording material 9 to which the toner image is transferred to go through between the heating roller 4*a* and the pressure roller 4*b*, and performs a heating operation and a pressure operation on the recording material 9. The fixing unit 4 then fixes the toner image to the recording material 9. The heating roller 4*a* includes a heater 4*c*. Temperature of the heating roller 4*a* rises due to heating of the heater 4*c*. Temperature for the heating operation or pressure for the pressure operation in the fixing unit 4 are adjusted as required in accordance with the characteristic of the recording material 9. The recording material 9 is passed though the fixing unit 4 so that the toner image is fixed to the recording material 9. The recording material 9 with the fixed toner image is then delivered on the paper delivery tray 6 from the delivery port 5.

The controller 7 controls operations of each aforementioned unit. The controller 7 is connected to a network such as LAN (Local Area Network) which is not illustrated in FIG. 1. After receiving a print job over the network, the controller 7 drives the paper feeding unit 2, the image forming unit 3 and a fixing unit 4 to control to form the image on the recording material 9. When the characteristic of the recording material 9 stored in the paper feeding cassette 8 has already been detected by the recording material characteristic detecting device 30, the controller 7 sets values such as the carrying speed of the recording material 9 and/or the parameter of the fixing operation by the fixing unit 4 based on the detected characteristic of the recording material 9. When, on the other hand, opening and closing of the paper feeding cassette 8 is detected by the paper feeding cassette switching sensor 8*a* prior to starting feeding of the recording material 9, there is a possibility that the recording material 9 stored in the paper feeding cassette 8 has been switched to the different type of the recording material 9 from the one before the opening and closing of the paper feeding cassette 8. When the controller 7 starts feeding the first recording material 9 after the detection of the opening and closing of the paper feeding cassette 8 by the paper feeding cassette switching sensor 8*a*, the controller 7 sets the carrying speed to a predetermined speed to prevent occurrence of a jam during carrying of the recording material 9. After setting the carrying speed, the controller 7 sends a characteristic detecting order to the recording material characteristic detecting device 30. The recording material characteristic detecting device 30 then starts an operation to detect the characteristic of the recording material 9.

Figure 2:
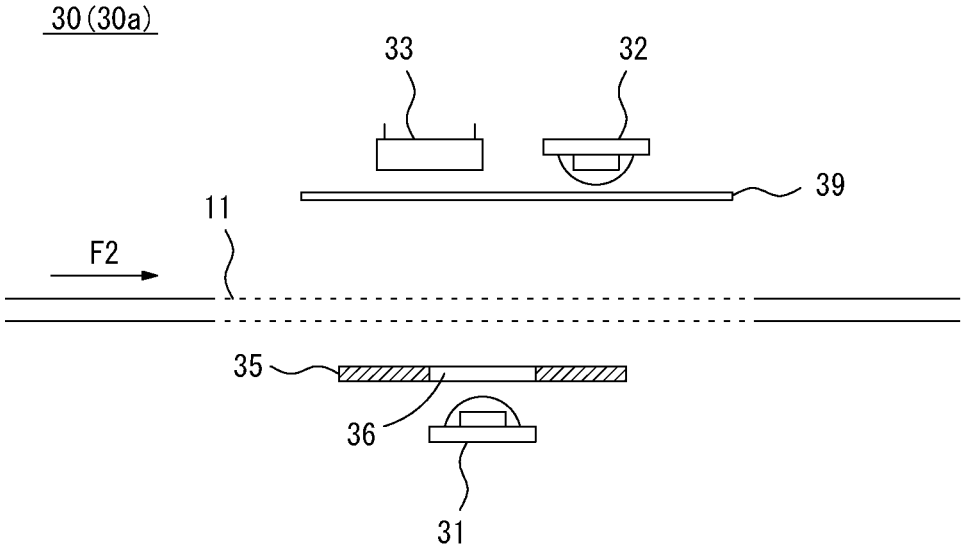
FIG. 2 illustrates an exemplary structure of a sensor unit of a recording material characteristic detecting device in which a first preferred embodiment may be practiced.

FIG. 2 illustrates an exemplary structure of the sensor unit 30*a* of the recording material characteristic detecting device 30. The recording material characteristic detecting device 30 irradiates two types of lights, a first light and a second light, to the recording material 9 carried along the carrying path 11. The recording material characteristic detecting device 30 detects a transmitted light generated when the first light transmits the recording material 9 and a reflection light generated when the second light is reflected from the recording material 9, and detects the characteristic of the recording material 9. To be more specific, the recording material characteristic detecting device 30 includes the sensor unit 30*a* which is arranged near the carrying path 11. The sensor unit 30*a* includes a transmitted light source 31, a reflection light source 32, a light detecting component 33, a reference plate for reflection light 35, and a transparent protective material 39.

The transmitted light source 31 is arranged near the carrying path 11. The transmitted light source 31 is a light source for transmitted light. The transmitted light source 31 irradiates the first light to the carrying path 11. The transmitted light source 31 of the first preferred embodiment, for example, uses a LED light source that emits a blue light having a wavelength 450 to 495 nm as the first light.

The reflection light source 32 is arranged near the carrying path 11. The reflection light source 32 is a light source for reflection light. The reflection light source 32 irradiates the second light to the carrying path 11. The reflection light source 32 is opposite to the transmitted light source 31 across the carrying path 11. To be more specific, the reflection light source 32 and the transmitted light source 31 face each other across the carrying path 11. The reflection light source 32 emits a second light having a wavelength different from the transmitted light source 31. The reflection light source 32 of the first preferred embodiment, for example, uses a LED light source that emits a red light having a wavelength 620 to 750 nm as the second light.

The light detecting component 33 is a receiving component formed from a component such as a photo diode. The light detecting component 33 has sensitivity to both of the first light irradiated from the transmitted light source 31 and the second light irradiated from the reflection light source 32. The light detecting component 33 is a sensor that receives each of the first and the second lights and measures a light amount of each light. To be more specific, in the first preferred embodiment, the single light detecting component 33 is enabled to detect both the first light irradiated from the transmitted light source 31 and the second light irradiated from the reflection light source 32. The sensor unit 30*a*, hence, can be downsized and formed at low cost. However, this is given not for limitation. A sensor receives the first light and a sensor receives the second light may be provided separately.

The light detecting component 33 is adjacent to the reflection light source 32. The light detecting component 33 is opposite to the transmitted light source 31 across the carrying path 11. More specifically, the light detecting component 33 and the transmitted light source 31 face each other across the carrying path 11.

The reference plate for reflection light 35 is a reflection plate to reflect the second light irradiated from the reflection light source 32 when the recording material 9 is not on the carrying path 11. The reference plate for reflection light 35 enables a reflection light as a reference to enter into the light detecting component 33. The reference plate for reflection light 35 is, for example, arranged between the carrying path 11 and the transmitted light source 31. The transmitted light source 31 is arranged on a back side of the reference plate for reflection light 35. The reference plate for reflection light 35 is preferably arranged at a position separated by a predetermined space from the carrying path 11 not to be in contact with the recording material 9 passing though the carrying path 11. The reference plate for reflection light 35 includes an aperture 36 in its center. The reference plate for reflection light 35 leads the first light irradiated from the transmitted light source 31 toward the carrying path 11 via the aperture 36. The aperture 36 also plays a role to control an optical path of the first light.

The reference plate for reflection light 35 reflects only the second light irradiated from the reflection light source 32 and does not reflect the first light irradiated from the transmitted light source 31. The reference plate for reflection light 35 may be formed as a red reflection plate so that it may only reflect the red light irradiated from the reflection light source 32. Alternatively, when the reference plate for reflection light 35 is formed as a yellow plate which is a complementary color of blue, the reference plate for reflection light 35 does not only reflect a blue light irradiated from the transmitted light source 31.

The reference plate for reflection light 35 does not have to be a plate that does not reflect the first light irradiated from the transmitted light source 31 at all. More specifically, the reference plate for reflection light 35 is only require to have a reflectivity of the second light higher than a reflectivity of the first light. The reflectivity of the first light may not be 0. The reflectivity of the first light, however, is preferably set in advance to a value which can be regarded as almost 0.

A function to reflect the second light may be provided to a whole part of the reflection plate of the reference plate for reflection light 35 or may be provided only to a surface facing the carrying path 11. A filter that absorbs and does not reflect the first light may be attached to the surface of the reference plate for reflection light 35.

The reference plate for reflection light 35 does not always have to be positioned between the carrying path 11 and the transmitted light source 31. The reference plate for reflection light 35 may be adjacent to the transmitted light source 31. In this case, installation of the aforementioned aperture 36 is not particularly necessary.

The transparent protective material 39 is a transparent plate-like body that transmits both of the first and the second lights. The transparent protective material 39 is a protective material that protects adhesion of paper powder flew out from the recording material 9 carried along the carrying path 11 to the surface of the reflection light source 32 and/or the light detecting component 33.

The recording material characteristic detecting device 30 having the above-described structure measures the light amounts of the first light and the second light as reference light amounts without having the recording material 9 positioned on the carrying path 11 when detecting the characteristic of the recording material 9. The recording material characteristic detecting device 30, for example, first turns on the transmitted light source 31 and measures the light amount of the first light enters directly into the light detecting component 33 from the transmitted light source 31 as a reference transmitted light amount. The recording material characteristic detecting device 30 then turns on the reflection light source 32 and measures the light amount of the reflection light as a reference reflection light amount. The reflection light is generated when the second light irradiated from the reflection light source 32 is reflected from the reference plate for reflection light 35, and the light reflected from the reference plate for reflection light 35 enters into the light detecting component 33. Either of the transmitted light source 31 or the reflection light source 32 may be turned on first.

Figure 3A:
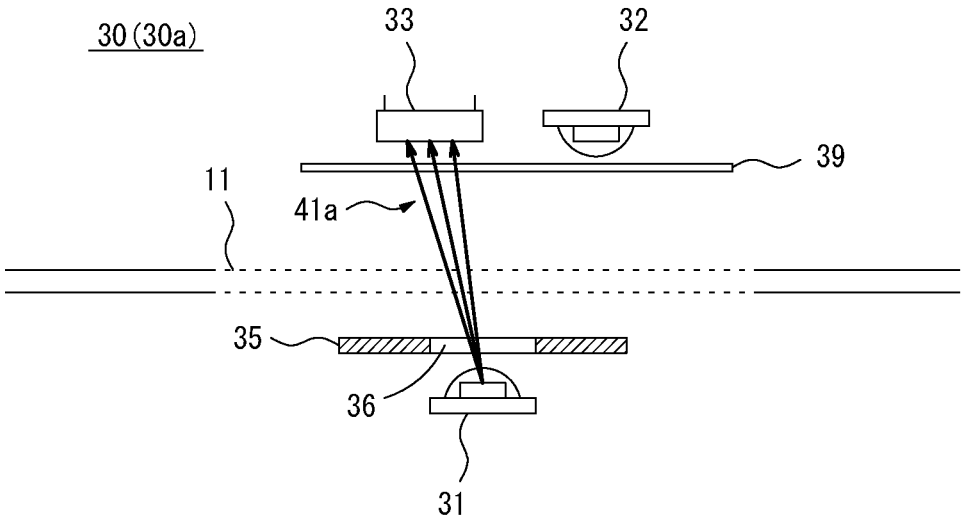
FIGS. 3A and 3B illustrate a concept of the sensor unit in measurement of a reference transmitted light amount and a reference reflection light amount.
Figure 3B:
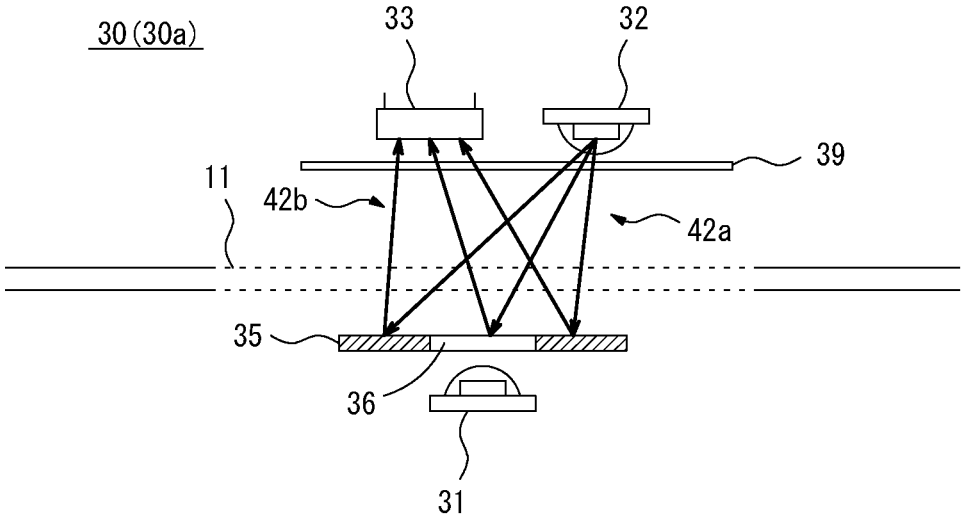

FIGS. 3A and 3B illustrate a concept of the sensor unit 30*a* in measurement of the reference transmitted light amount and the reference reflection light amount. When the recording material characteristic detecting device 30 lights the transmitted light source 31 without the recording material 9 positioned on the carrying path 11 as illustrated in FIG. 3A, a first light 41*a* emitted from the transmitted light source 31 directly enters into the light detecting component 33. Thus, the light detecting component 33 is enabled to measure the reference transmitted light amount in accordance with a light receiving amount of the first light emitted from the transmitted light source 31. The recording material characteristic detecting device 30 temporarily stores the reference transmitted light amount measured as described above. The recording material characteristic detecting device 30 turns off the transmitted light source 31 after completing the measurement of the reference transmitted light amount.

When the recording material characteristic detecting device 30 lights the reflection light source 32 without the recording material 9 positioned on the carrying path 11 as illustrated in FIG. 3B, a second light 42*a* emitted from the reflection light source 32 is reflected by the reference plate for reflection light 35, and a reflection light 42*b* enters into the light detecting component 33. Thus, the light detecting component 33 is enabled to measure the reference reflection light amount in accordance with a light receiving amount of the reflection light 42*b* reflected by the reference plate for reflection light 35. The recording material characteristic detecting device 30 temporarily stores the reference reflection light amount measured as described above. The recording material characteristic detecting device 30 turns off the reflection light source 32 after completing the measurement of the reference reflection light amount. As described above, the measurement operation performed without the recording material 9 positioned on the carrying path 11 is complete.

The recording material characteristic detecting device 30 measures the light amount of the transmitted light generated when the first light transmits the recording material 9 and the reflection light generated when the surface of the recording material 9 reflects the second light as the recording material 9 is positioned at a measurement objective position on the carrying path 11. The recording material characteristic detecting device 30 first, for example, lights the transmitted light source 31, and measures the light amount of the transmitted light generated when the first light transmits the recording material 9 and enters into the light detecting component 33 as a recording material transmitted light amount. The recording material characteristic detecting device 30 then lights the reflection light source 32, and measures the light amount of the reflection light generated when the second light emitted from the reflection light source 32 is reflected by the recording material 9 and enters into the light detecting component 33 as a recording material reflection light amount. Also in this case, either of the transmitted light source 31 or the reflection light source 32 may be turned on first.

Figure 4A:
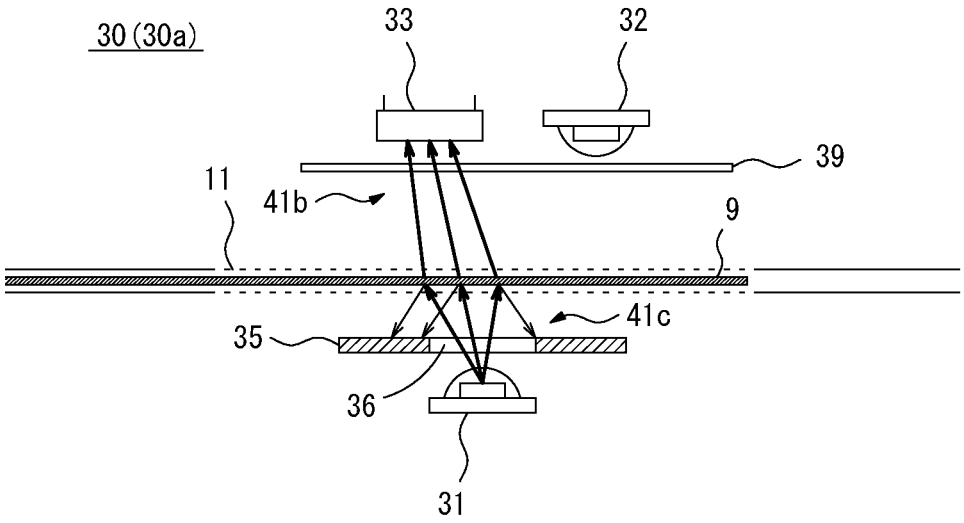
FIGS. 4A and 4B illustrate a concept of the sensor unit in measurement of a recording material transmitted light amount and a recording material reflection light amount.
Figure 4B:
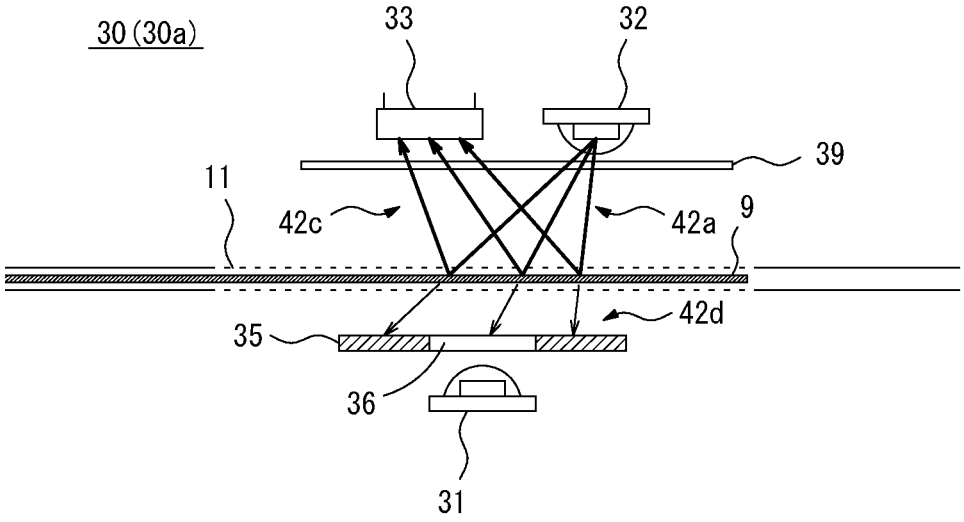

FIGS. 4A and 4B illustrate a concept of the sensor unit 30*a* in measurement of the recording material transmitted light amount and the recording material reflection light amount. When the recording material characteristic detecting device 30 lights the transmitted light source 31 with the recording material 9 positioned on the carrying path 11 as illustrated in FIG. 4A, the first light is emitted from the transmitted light source 31, and a part of light components transmits the recording material 9. A transmitted light 41*b* that transmitted the recording material 9 enters into the light detecting component 33. Thus, the light detecting component 33 is enabled to measure the recording material transmitted light amount in accordance with the light receiving amount of the transmitted light which transmitted the recording material 9.

The part of the first light emitted from the transmitted light source 31 is reflected by the surface of the recording material 9, and generates a reflection light 41*c* toward the reference plate for reflection light 35. The reflection light 41*c* is not reflected by the reference plate for reflection light 35 but absorbed. According to the first preferred embodiment, the reflection light 41*c* reflected by the surface of the recording material 9 does not transmit the recording material 9 or enter into the light detecting component 33 like a conventional one. To be more specific, the recording material characteristic detecting device 30 of the first preferred embodiment controls not to have generation of an irregular reflection of the first light between the recording material 9 and the reference plate for reflection light 35 so that the recording material transmitted light amount may be measured accurately.

The recording material characteristic detecting device 30 temporarily stores the recording material transmitted light amount measured as described above. Once the measurement of the recording material transmitted light amount is complete, the recording material characteristic detecting device 30 turns off the transmitted light source 31. The thicker the recording material 9, for instance, the less the recording material transmitted light amount is generated. In contrast, the thinner the recording material 9, for instance, the more the recording material transmitted light amount is generated. Hence, the recording material transmitted light amount measured as described above is one of data indicating the characteristic of the recording material 9.

When the recording material characteristic detecting device 30 lights the reflection light source 32 with the recording material 9 positioned on the carrying path 11 as illustrated in FIG. 4B, the second light 42*a* emitted from the reflection light source 32 is reflected by the recording material 9, and a reflection light 42*c* enters into the light detecting component 33. The light detecting component 33 is enabled to measure the recording material reflection light amount in accordance with the light receiving amount of the reflection light 42*c* which is reflected by the recording material 9.

A part of the second light emitted from the reflection light source 32 transmits the recording material 9, and generates a transmitted light 42*d* towards the reference plate for reflection light 35. The transmitted light 42*d* may be repeatedly reflected by the recording material 9 and the reference plate for reflection light 35, and may transmit again the recording material 9. An amount of attenuation of the light that transmits the recording material 9 is generally large. The light once transmitted the recording material 9 again transmitting the recording material 9 does not have a light amount as affecting the recording material reflection amount which is measured by the light detecting component 33. Even when a part of the second light 42*a* emitted from the reflection light source 32 transmits the recording material 9, the transmitted light 42*d* does not affect the measurement of the recording material reflection light amount. More specifically, the light detecting component 33 is enabled to measure the recording material reflection light amount accurately.

The recording material characteristic detecting device 30 temporarily stores the recording material reflection light amount measured as described above. Once the measurement of the recording material reflection light amount is complete, the recording material characteristic detecting device 30 turns off the transmitted light source 31. The recording material 9 having glossiness on its surface, for instance, increases the recording material reflection light amount. Hence, the recording material reflection light amount measured as described above is one of data indicating the characteristic of the recording material 9.

Figure 5A:
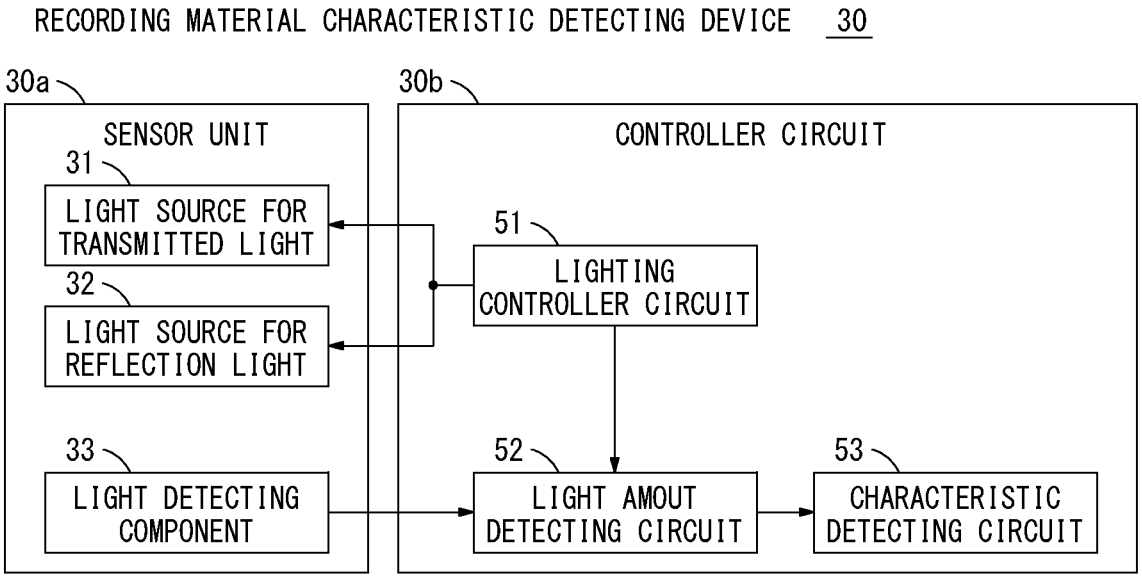
FIGS. 5A and 5B illustrate an example of a circuit structure of the recording material characteristic detecting device.
Figure 5B:
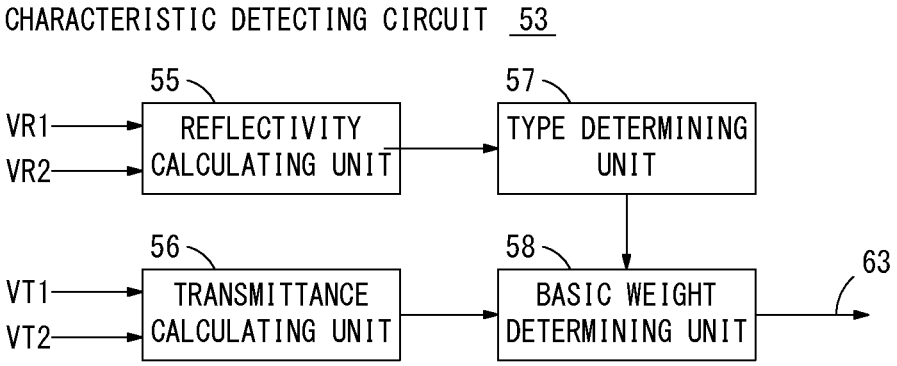

A circuit structure for the recording material characteristic detecting device 30 to detect the characteristic of the recording material 9 is explained next. FIGS. 5A and 5B illustrate an example of the circuit structure of the recording material characteristic detecting device 30. As illustrated in FIG. 5A, the recording material characteristic detecting device 30 includes the sensor unit 30*a* and a controller circuit 30*b*. The sensor 30*a* includes the transmitted light source 31, the reflection light source 32 and the light detecting component 33 as described above, and is positioned near the carrying path 11.

The controller circuit 30*b* is a circuit that controls the sensor unit 30*a* to detect the characteristic of the recording material 9. The controller circuit 30*b* includes a lighting controller circuit 51, a light amount detecting circuit 52 and a characteristic detecting circuit 53. Once receiving the characteristic detecting order from the controller 7 of the image forming device 1, the detecting circuit 30*b*, for example, starts processing to detect the characteristic of the recording material 9. The controller circuit 30*b* measures the light amount under a circumstance that the recording material 9 is not positioned on the carrying path 11 before the recording material 9 reaches the measurement object position in the carrying path 11. The controller circuit 30*b* then measures the light amount under a circumstance that the recording material 9 is positioned on the carrying path 11 once the recording aterial 9 is reached the measurement object position in the carrying path 11.

The lighting controller circuit 51 drives each of the transmitted light source 31 and the reflection light source 32 to control turning on and off of the respective first and second lights. The light amount detecting circuit 52 becomes operative in synchronization with the lighting controller circuit 51 to detect the light amount of the light the light detecting component 33 receives based on a signal output from the light detecting component 33 while the first light or the second light is irradiated.

When, for instance, the transmitted light source 31 is lighted without the recording material 9 positioned on the carrying path 11, the light amount detecting circuit 52 detects a reference transmitted light amount VT1 based on the signal output from the light detecting component 33. When the reflection light source 32 is lighted without the recording material 9 positioned on the carrying path 11, the light amount detecting circuit 52 detects a reference reflection light amount VR1 based on the signal output from the light detecting component 33. When the transmitted light source 31 is lighted with the recording material 9 positioned on the carrying path 11, the light amount detecting circuit 52 detects a recording material transmitted light amount VT2 based on the signal output from the light detecting component 33. When the reflection light source 32 is lighted with the recording material 9 positioned on the carrying path 11, the light amount detecting circuit 52 detects a recording material reflection light amount VR2 based on the signal output from the light detecting component 33. The light amount detecting circuit 52 then outputs the detected light amounts to the characteristic detecting circuit 53.

The characteristic detecting circuit 53 is a characteristic detector that detects the characteristic of the recording material 9 based on the light amounts (the reference transmitted light amount VT1, the reference reflection light amount VR1, the recording material transmitted light amount VT2 and the recording material reflection light amount VR2) received from the light amount detecting circuit 52. The characteristic detecting circuit 53 includes a reflectivity calculating unit 55, a transmittance calculating unit 56, a type determining unit 57 and a basic weight determining unit 58 as illustrated in FIG. 5B, for instance. As the characteristic of the recording material 9, the characteristic detecting circuit 53 detects the type and the basic weight of the recording material 9.

The reflectivity calculating unit 55 calculates the reflectivity of the recording material 9 based on the reference reflection light amount VR1 and the recording material reflection light amount VR2. The reflectivity calculating unit 55, for example, calculates a ratio of the reference reflection light amount VR1 and the recording material reflection light amount VR2 (VR2/VR1), and obtains the ratio as the reflectivity. The reflectivity calculating unit 55 then outputs the reflectivity of the recording material 9 to the type determining unit 57.

The transmittance calculating unit 56 calculates the transmittance of the recording material 9 based on the reference transmitted light amount VT1 and the recording material transmitted light amount VT2. The transmittance calculating unit 56, for example, calculates a ratio of the reference transmitted light amount VT1 and the recording material transmitted light amount VT2 (VT2/VT1), and obtains the ratio as the transmittance. The reflectivity calculating unit 55 then outputs the transmittance of the recording material 9 to the basic weight determining unit 58.

The type determining unit 57 determines the type of the recording material 9. The type determining unit 57 determines which of the plain paper, the recycled paper and the coated paper is the type of the recording material 9 based on the reflectivity of the recording material 9. The type determining unit 57 outputs a determination result indicating the type of the recording material 9 to the basic weight determining unit 58.

Figure 6:
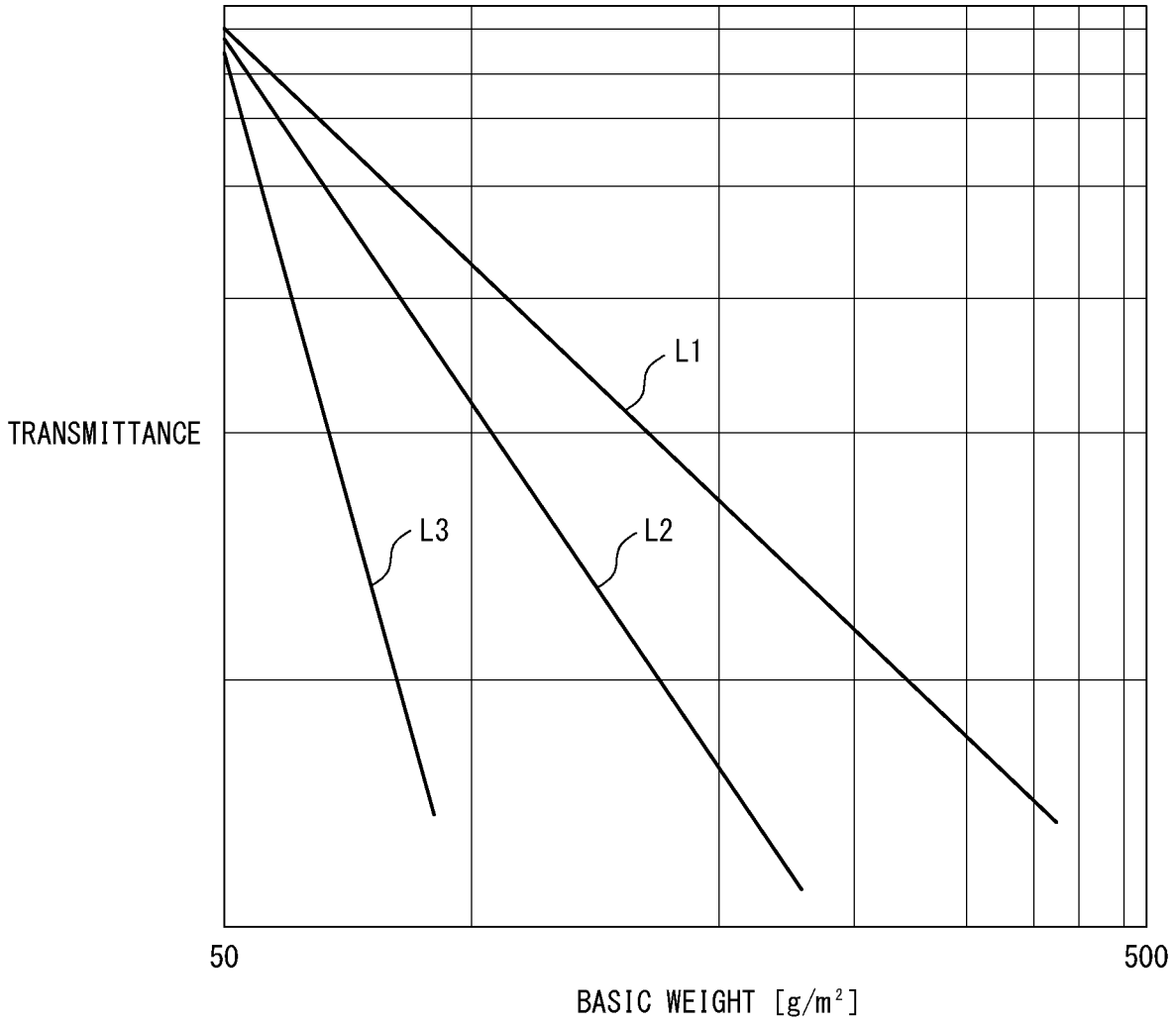
FIG. 6 illustrates an example of table information that includes a transmittance and a basic weight corresponding to each type of a recording material.

The basic weight determining unit 58 determines the basic weight of the recording material 9. The basic weight determining unit 58 determines the basic weight of the recording material 9 based on the type of the recording material 9 determined by the type determining unit 57 and the transmittance calculated by the transmittance calculating unit 56. The basic weight determining unit 58 stores table information in which the transmittance and the basic weight corresponding to each type of the recording material 9 is recorded in advance. The basic weight determining unit 58, for example, refers to the table information to determine the basic weight of the recording material 9. FIG. 6 illustrates an example of the table information. In the table information of FIG. 6, for example, three characteristic lines L1 to L3 are shown. The characteristic line L1 shows a correspondency between the transmittance and the basic weight of the plain paper. The characteristic line L2 shows a correspondency between the transmittance and the basic weight of the coated paper. The characteristic line L3 shows a correspondency between the transmittance and the basic weight of the recycled paper. The basic weight determining unit 58 selects one of the three characteristic lines L1 to L3 based on the determination result by the type determining unit 57, and obtains the basic weight corresponding to the transmittance of the recording material 9 based on the selected characteristic line. The basic weight determining unit 58 then is enabled to specify the basic weight of the recording material 9. The basic weight determining unit 58 outputs the type and the basic weight of the recording material 9 thereby specified as characteristic information 63. The characteristic information 63 is output to the controller 7 of the image forming device 1.

Figure 7:
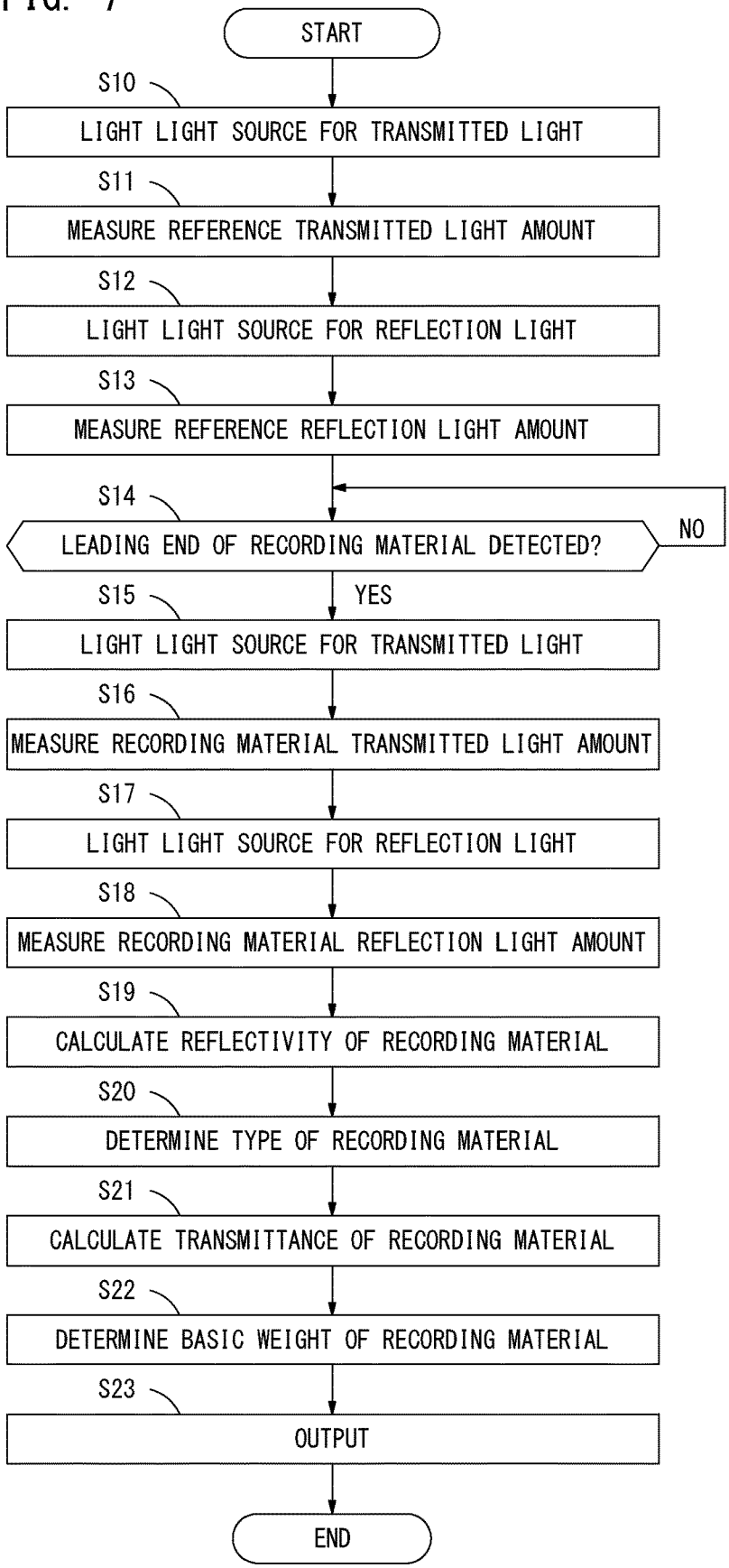
FIG. 7 illustrates a flow diagram explaining an exemplary procedure of a process performed at the recording material characteristic detecting device.

A process sequence performed by the controller circuit 30*b* is explained next. FIG. 7 illustrates a flow diagram explaining an exemplary procedure of a process performed by the controller circuit 30*b*. This process is started when the controller circuit 30*b* receives the characteristic detecting order from the controller 7. Upon start of the process, the controller circuit 30*b* lights the transmitted light source 31 without the recording material 9 positioned on the measurement object position in the carrying path 11 (step S10), and measures the reference transmitted light amount (step S11). The controller circuit 30*b* lights the reflection light source 32 without the recording material 9 positioned on the measurement object position in the carrying path 11 (step S12), and measures the reference reflection light amount (step S13). The controller circuit 30*b* waits until detecting the leading end of the recording material 9 has passed through the measurement object position (step S14). The lighting of the reflection light source 32 lighted in step S12 may be kept being lighted and a change made in the light amount of the light received by the light detecting component 33 within a predetermined period of time may be detected, for example. The change then enables detection of the passage of the leading end of the recording material 9 through the measurement object position. A way of detecting the passage of the leading end of the recording material 9 can be any other ways except for the above-described way.

When detecting that the leading end of the recording material 9 has passed through the measurement object position (when a result of step S14 is YES), the controller circuit 30*b* lights the transmitted light source 31 with the recording material 9 positioned on the measurement object position in the carrying path 11 (step S15), and measures the recording material transmitted light amount (step S16). Also, the controller circuit 30*b* lights the reflection light source 32 with the recording material 9 positioned the measurement object position in the carrying path 11 (step S17), and measures the recording material reflection light amount (step S18).

The controller circuit 30*b* then calculates the reflectivity of the recording material 9 based on the reference reflection light amount and the recording material reflection light amount (step S19), and determines the type of the recording material 9 based on the reflectivity of the recording material 9 (step S20). Also, the controller circuit 30*b* calculates the transmittance of the recording material 9 based on the reference transmitted light amount and the recording material transmitted light amount (step S21), and determines the basic weight of the recording material 9 based on the type and the transmittance of the recording material 9 (step S22). The controller circuit 30*b* then outputs the type and the basic weight of the recording material 9 as the characteristic information 63 (step S23). As described above, the process performed by the recording material characteristic detecting device 30 completes. When the controller circuit 30*b* is formed from the CPU and the memory, the above-described procedure of the process may be applied as a procedure of a process performed by the CPU based on a predetermined program.

Figure 8:
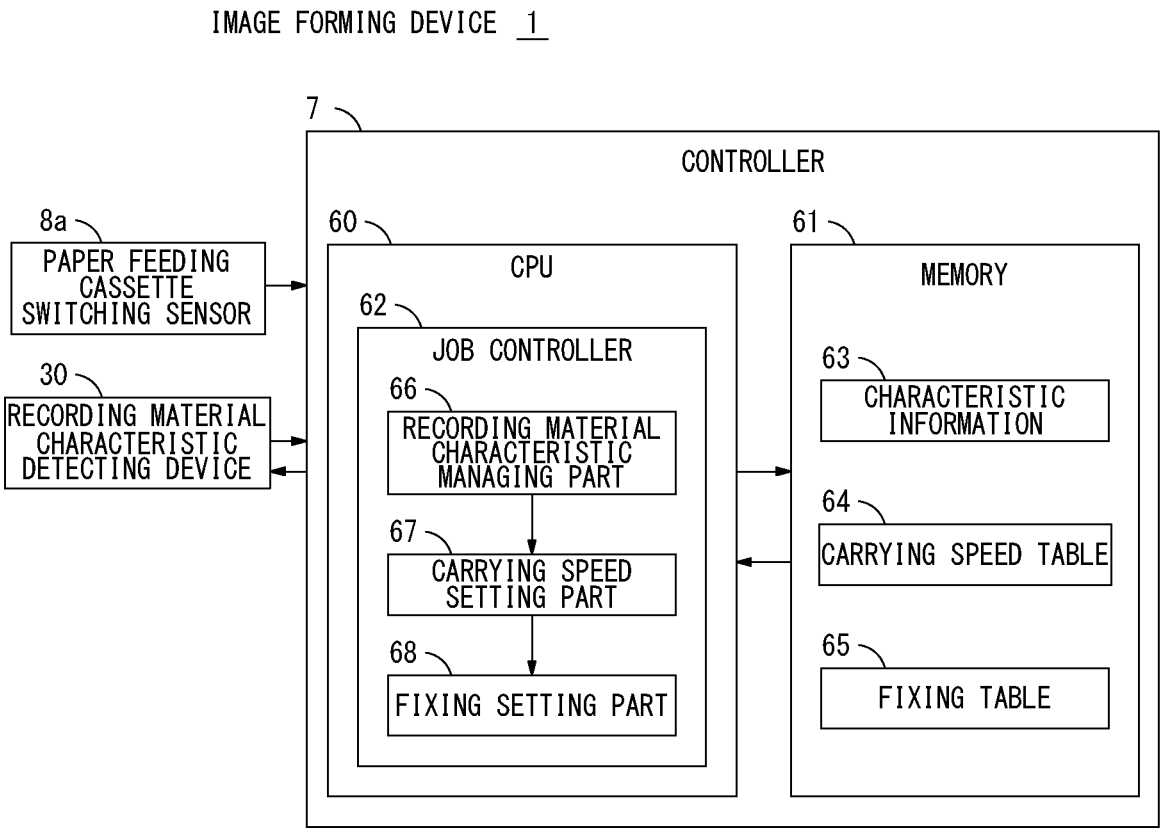
FIG. 8 illustrates a block diagram showing an example of a hardware structure of a controller of the image forming device.

FIG. 8 illustrates a block diagram showing an example of a hardware structure of the controller 7 of the image forming device 1. The controller 7 includes a CPU 60 and a memory 61 as illustrated in FIG. 8. The CPU 60 executes a control program installed in advance in the controller 7 so that it serves as a job controller 62. The job controller 62 controls processing of a print job in the image forming device 1. The memory 61 is a rewritable non-volatility recording medium in which a variety of information is stored. The above-described control program is stored in advance in the memory 61. The characteristic information 63 output from the recording material characteristic detecting device 30 is stored in the memory 61. A carrying speed table 64 and a fixing table 65 are also stored in advance in the memory 61. The carrying speed table 64 is table information for determining the carrying speed corresponding to the characteristic information 63. The fixing table 65 is table information for determining a parameter of the fixing process corresponding to the characteristic information 63.

The job controller 62 includes a recording material characteristic managing part 66, a carrying speed setting part 67 and a fixing setting part 68.

The recording material characteristic managing part 66 manages the characteristic of the recording material 9 carried along the carrying path 11. The recording material characteristic managing part 66 stores the characteristic information 63 received from the recording material characteristic detecting device 30 in the memory 61 and manages. When the job controller 62 starts processing of the print job, the recording material characteristic managing part 66 reads the characteristic information 63 in the memory 61, and outputs the read characteristic information 63 to the carrying speed setting part 67 and the fixing setting part 68.

The carrying speed setting part 67 sets the carrying speed for carrying the recording material 9. Once obtaining the characteristic information 63 from the recording material characteristic managing part 66, the carrying speed setting part 67 refers to the carrying speed table 64 based on the obtained characteristic information 63, and sets the carrying speed corresponding to the characteristic of the recording material 9 identified in the characteristic information 63. More specifically, the carrying speed thereby set is the carrying speed that is appropriate for the characteristic of the recording material 9 and that does not cause jams easily and enables to demonstrate maximum throughput.

The fixing setting part 68 sets a temperature of the heater 4*c* and a pressure exerted on the recording material 9 when the fixing processing is performed by the fixing unit 4. Once obtaining the characteristic information 63 from the recording material characteristic managing part 66, the fixing setting part 68 sets the temperature of the heater 4*c* and the pressure exerted on the recording material 9 based on the characteristic information 63. To be more specific, the parameter appropriate for the characteristic of the recording material 9 is set as the parameter of heating.

The recording material characteristic managing part 66 regularly monitors whether the opening and closing operation of the paper feeding cassette 8 is detected by the paper feeding cassette switching sensor 8*a*. Once the opening and closing operation of the paper feeding cassette 8 is detected, the recording material characteristic managing part 66 recognizes the characteristic information 63 stored in the memory 61 as information that is no longer be useful. The job controller 62 may start processing of the print job after the detection of the opening and closing operation of the paper feeding cassette 8. In this case, the recording material characteristic managing part 66 sends the characteristic detecting order to the recording material characteristic detecting device 30. As a result, the recording material characteristic managing part 66 is enabled to obtain the latest characteristic information 63 from the recording material characteristic detecting device 30 at a time of feeding a first sheet of the recording material 9 after a start of processing of the print job. The recording material characteristic managing part 66 is also enabled to update the characteristic information 63 in the memory 61.

The recording material characteristic managing part 66 notifies each of the carrying speed setting part 67 and the fixing setting part 68 that the characteristic of the recording material 9 is not clear after sending the characteristic detecting order. When the characteristic of the recording material 9 is not clear, the carrying speed setting part 67 sets the predetermined carrying speed as the carrying speed of the recording material 9. The predetermined carrying speed may be a lowest speed that does not cause jams easily with any type of recording material 9. When the characteristic of the recording material 9 is not clear, the carrying speed setting part 67 sets the predetermined parameter as the parameter of the fixing processing. The predetermined parameter may be a parameter that enables to perform fixing processing on any type of recording material 9, for example.

The recording material characteristic managing part 66 obtains the latest characteristic information 63 from the recording material characteristic detecting device 30 at the time of feeding the first sheet of the recording material 9 after the start of processing of the print job. The recording material characteristic managing part 66 then outputs the obtained latest characteristic information 63 to the carrying speed setting part 67 and the fixing setting part 68. As a result, the carrying speed setting part 67 is enabled to change the carrying speed of the recording material 9 to be applied to the later process to the carrying speed corresponding to the characteristic of the recording material 9. Also, the carrying speed setting part 67 is enabled to change the parameter of the fixing processing to be applied to the later fixing processing to the parameter corresponding to the characteristic of the recording material 9. Even during the processing of the print job, the settings of the carrying speed of the recording material 9 and the parameter of the fixing processing can be changed to the values appropriate for the characteristic of the recording material 9.

Figure 9:
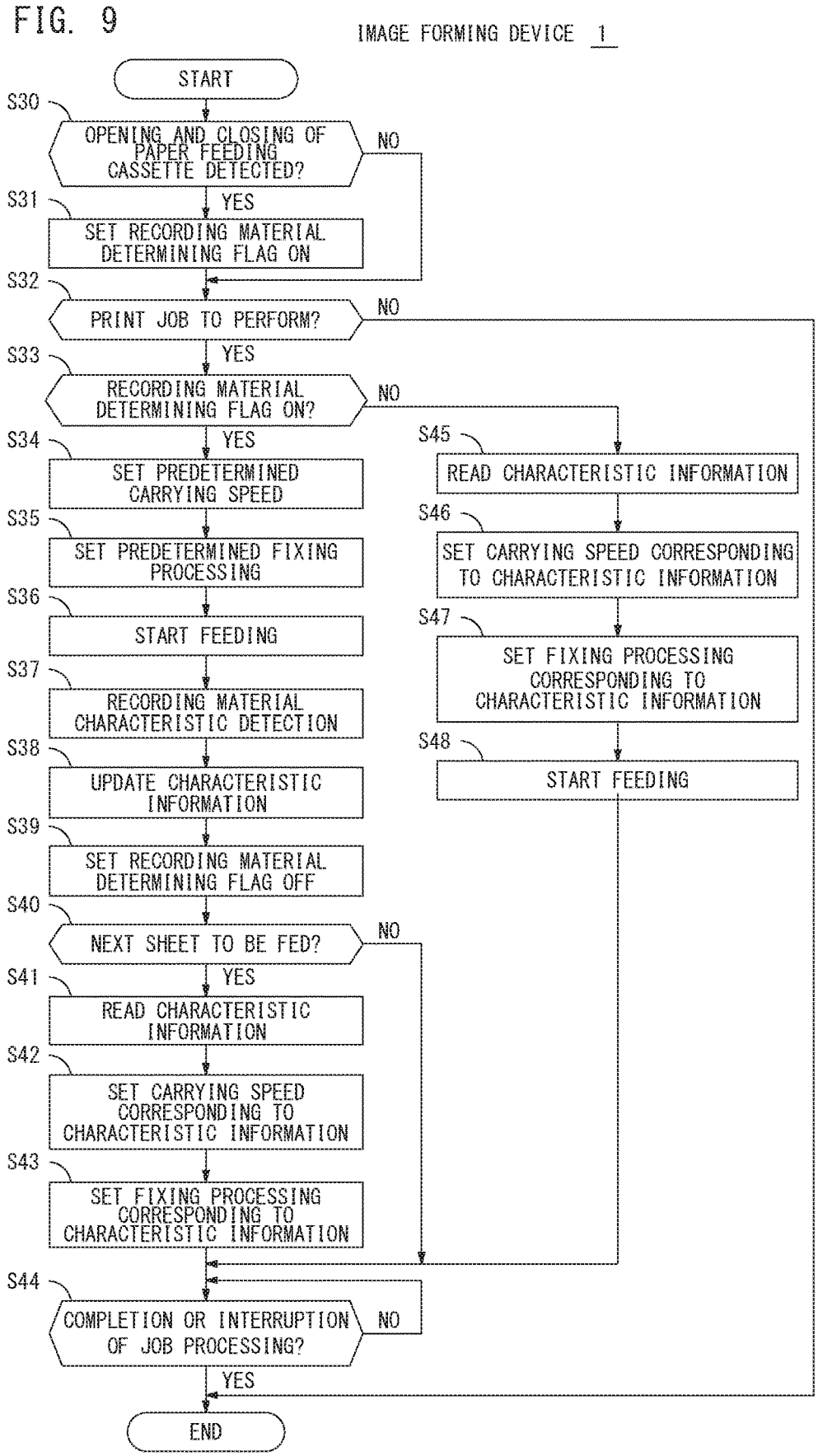
FIG. 9 illustrates a flow diagram explaining an exemplary procedure of a process performed by the image forming device.

FIG. 9 illustrates a flow diagram explaining an exemplary procedure of a process performed by the image forming device 1. This process is started when the controller 7 repeatedly executes the control program. Upon start of the process, the controller 7 determines if the opening and closing of the paper feeding cassette 8 is detected (step S30). When the opening and closing of the paper feeding cassette 8 is detected (when a result of step S30 is YES), the controller 7 sets a recording material determining flag on (step S31). When the opening and closing of the paper feeding cassette 8 is not detected (when a result of step S30 is NO), the recording material determining flag is off.

The controller 7 then determines if there is the print job that should be performed by the image forming device 1 (step S32). When, for example, receipt of the new print job over the network is detected or the status that the print job interrupted during the processing gets restartable is detected, the controller 7 determines that there is the print job to process. If there is no print job to be processed by the image forming device 1 as a result of the determination (when a result of step S32 is NO), the process by the controller 7 is complete. If, on the other hand, there is the print job to be processed by the image forming device 1 as a result of the determination (when a result of step S32 is YES), the process by the controller 7 proceeds to step S33.

When processing the print job, the controller 7 determines if the recording material determining flag is on (step S33). When the recording material determining flag is on (when a result of step S33 is YES), the characteristic of the recording material 9 stored in the paper feeding cassette 8 is not identified. The controller 7 then sets the predetermined carrying speed (for example, the lowest speed) as the carrying speed of the recording material 9 (step S34), and sets the predetermined parameter as the parameter such as the temperature and the pressure applied at the fixing processing (step S35). The controller 7 then drives the paper feeding unit 2 to start feeding the recording material 9 (step S36).

After starting feeding the recording material 9, the controller 7 performs a recording material characteristic detection (step S37). To be more specific, the controller 7 sends the characteristic detecting order to the recording material characteristic detecting device 30. The recording material characteristic detecting device 30 then performs the process to detect the characteristic of the recording material 9. The controller 7 then obtains the characteristic information 63 from the recording material characteristic detecting device 30, and updates the characteristic information 63 in the memory 61 to the latest information (step S38). After updating the characteristic information 63, the controller 7 sets the recording material determining flag off (step S39).

The controller 7 then determines whether or not the next sheet is to be fed (the sheet after the second sheet is to be fed) during the processing of the present print job (step S40). When the next sheet is to be fed (when a result of step S40 is YES), the controller 7 reads the characteristic information 63 in the memory 61 (step S41). The controller 7 changes the setting of the carrying speed of the recording material 9 to the carrying speed corresponding to the characteristic information 63 (step S42), also changes the setting of the parameter of the fixing processing to the parameter corresponding to the characteristic information 63 (step S43). Even during the processing of the print job, the carrying speed of the recording material 9 and the parameter of the fixing processing are changed. When the next sheet is not to be fed during the processing of the present print job (when a result of step S40 is NO), the process in step S41 to S43 is not performed. The controller 7 waits until completion or interruption of processing of the print job (step S44). When the processing of the print job is complete or the processing of the print job is interrupted (when a result of step S44 is YES), the controller 7 completes the process.

The recording material determining flag may be off when the print job is to be processed (when a result of step S33 is NO). In such a case, the controller 7 reads the characteristic information 63 in the memory 61 (step S45). The controller 7 sets the carrying speed of the recording material 9 to the carrying speed corresponding to the characteristic information 63 (step S46), also sets the parameter of the fixing processing to the parameter corresponding to the characteristic information 63 (step S47). The controller 7 then drives the paper feeding unit 2 to start feeding the first sheet of the recording material 9 (step S48). As described above, the controller 7 then waits until completion or interruption of processing of the print job (step S44). When the processing of the print job is complete or the processing of the print job is interrupted (when a result of step S44 is YES), the controller 7 completes the process.

The controller 7 repeatedly performs the process as described above so that it sets the recording material determining flag on at a timing when the opening and closing of the paper feeding cassette 8 is performed. The controller 7 then is enabled to automatically detect the characteristic of the recording material 9 and set the carrying speed and the parameter of the fixing processing to the appropriate values when the first sheet is to be fed after the opening and closing of the paper feeding cassette 8.

As described above, the recording material characteristic detecting device 30 of the first preferred embodiment includes the reference plate for reflection light 35 that reflects the second light irradiated from the reflection light source 32 arranged oppositely to the reflection light source 32. The reference plate for reflection light 35 faces the reflection light source 32 via the carrying path 11. The reference plate for reflection light 35 is formed to have higher reflectivity to the second light than the reflectivity to the first light. The transmitted light source 31 may be lighted with the recording material 9 positioned on the carrying path 11, and the first light may be reflected between the recording material 9 and the reference plate for reflection light 35. Even in such a case, the reflection light 41*c* is not reflected by the reference plate for reflection light 35, and absorbed. The recording material characteristic detecting device 30 of the first preferred embodiment is not affected by the irregular reflection light and is enabled to detect the accurate characteristic of the recording material 9.

The image forming device 1 of the first preferred embodiment correctly figures out the characteristic of the recording material 9 by using the above-described recording material characteristic detecting device 30, and controls that the operation for forming images on the recording material 9 to be an appropriate operation that is suitable for the characteristic of the recording material 9. As a result, there is a low possibility to have a jam occurred during carrying the recording material 9, and moreover, images may be formed at the maximum throughput corresponding to the characteristic of the recording material 9. Furthermore, high quality images can be formed on the recording material 9 without occurrence of fixing irregularities of the image transferred to the recording material 9.

As described above, the structure including the reference plate for reflection light may reduce effect of the irregular reflection light generated between the recording material and the reference plate for reflection light, and detect the accurate characteristic of the recording material.

Second Preferred Embodiment

The second preferred embodiment of the present invention is explained next. In the second preferred embodiment, an exemplary structure relating to the sensor unit 30*a* of the recording material characteristic detecting device 30, which is different from one explained in the above first preferred embodiment, is explained. The sensor unit 30*a* explained in the first preferred embodiment is arranged near a position where the recording material 9 passing through on the carrying path 11. The surfaces of the transmitted light source 31 and the reference plate for reflection light 35 are preferably covered by protective members. This is for protecting from stains such as paper powder or from the user touching in occurrence of the jam. In the second preferred embodiment, an exemplary structure of the sensor unit 30*a* provided with the above-described protective member is explained. The image forming device 1 mounting the recording material characteristic detecting device 30 of the second preferred embodiment is the same as one described in the first preferred embodiment.

Figure 10:
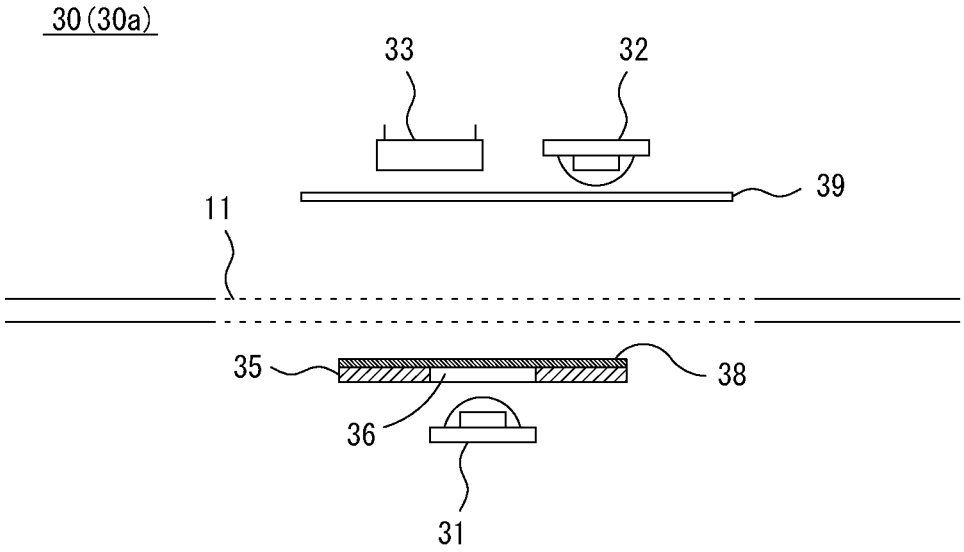
FIG. 10 illustrates an exemplary structure of the sensor unit of the recording material characteristic detecting device in which a second preferred embodiment may be practiced.

FIG. 10 illustrates an exemplary structure of the sensor unit 30*a* of the recording material characteristic detecting device 30 of the second preferred embodiment. A protective film 38 is stuck to a surface of the reference plate for reflection light 35 to cover the aperture 36, which is the difference between the sensor unit 30*a* of the FIG. 10 and one of FIG. 2.

As illustrated in FIG. 10, the reflection light source 32 and the light detecting component 33 are covered by the transparent protective member 39, which is the same as what explained in the first preferred embodiment. If the similar structure as the transparent protective material 39 is used for protecting the surfaces of the transmitted light source 31 and the reference plate for reflection light 35, an irregular reflection light of the first light is generated between the transparent protective member and the recording material 9, and the irregular reflection light negatively effects the measurement of the transmitted light that transmits the recording material 9. Especially, the transmitted light source 31 is arranged to face the light detecting component 33 so that the irregular reflection light may give a great effect. The same structure as the transparent protective material 39 for protecting the reflection light source 32 and the light detecting component 33 is not preferably used as the structure for protecting the surfaces of the transmitted light source 31 and the reference plate for reflection light 35.

For the sensor unit 30*a* of the second preferred embodiment, the protective film 38 is stuck to the surface of the reference plate for reflection light 35 to cover the aperture 36 so that both surfaces of the transmitted light source 31 and the reference plate for reflection light 35 are protected. As the protective film of this case, a film that has a feature of transmitting the first light irradiated from the transmitted light source 31 and reflecting the second light irradiated from the reflection light source 32 is used.

The reference plate for reflection light 35 of the second preferred embodiment preferably constructed as an absorbing body that absorbs the first light irradiated from the transmitted light source 31. A member such as a reflection board with the whole part colored in black, for instance, is considered as the absorbing body of this case. The reference plate for reflection light 35 is constructed as the absorbing body so that the reference plate for reflection light 35 is enabled to absorb the reflection light generated when the first light irradiated from the transmitted light source 31 toward the recording material 9 is reflected by the back of the recording material 9 and entered into the protective film 38. The reference plate for reflection light 35 is thus enabled to control occurrence of the reflection again.

A LED light source that emits an infrared light having a wavelength 750 nm or more may be used as the transmitted light source 31 and a LED light source that emits a blue light having a wavelength 450 to 495 nm may be used as the reflection light source 32, for example. In this case, an infrared transmission color film, for instance, may be used as the above-described protective film 38. The infrared transmission color film has a feature of transmitting the infrared light and reflecting a visible light, especially the blue light. However, this is given not for limitation. The protective film 38 having the aforementioned feature may be applied depending on the wavelength of the light emitted by each of the transmitted light source 31 and the reflection light source 32.

The structures and operations aside from ones described in the second preferred embodiment are the same as those described in the first preferred embodiment.

Third Preferred Embodiment

The third preferred embodiment of the present invention is explained next. In the third preferred embodiment, an exemplary structure relating to the sensor unit 30*a* of the recording material characteristic detecting device 30, which is different from ones explained in the above first and second preferred embodiments is explained. In the third preferred embodiment, an exemplary structure that enables to measure the first light irradiated from the transmitted light source 31 and the second light irradiated from the reflection light source 32 at the same time. The image forming device 1 mounting the recording material characteristic detecting device 30 of the third preferred embodiment is the same as one described in the first preferred embodiment.

Figure 11:
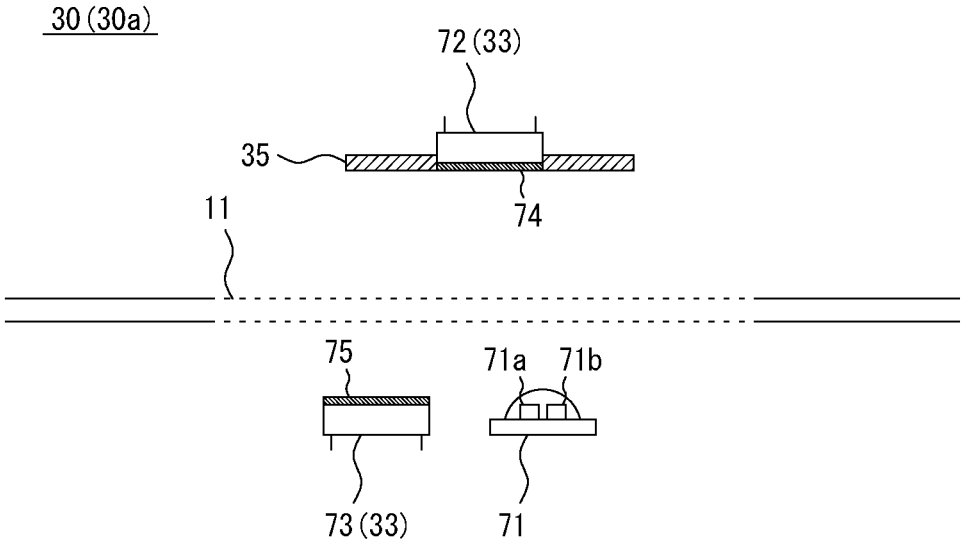
FIG. 11 illustrates an exemplary structure of the sensor unit of the recording material characteristic detecting device in which a third preferred embodiment may be practiced.

FIG. 11 illustrates an exemplary structure of the sensor unit 30*a* of the recording material characteristic detecting device 30 of the third preferred embodiment. The recording material characteristic detecting device 30 of the third preferred embodiment is provided with the sensor unit 30*a* that includes a light emitting element 71, a transmitted light detecting element 72, a reflection light detecting element 73 and the reference plate for reflection light 35. The sensor unit 30*a* is arranged near the carrying path 11.

A transmitted light source 71*a* and a reflection light source 71*b* are mounted inside the light emitting element 71. The transmitted light source 71*a* is a light source for transmitted light and the reflection light source 71*b* is a light source for reflection light. To be more specific, the sensor unit 30*a* of the third preferred embodiment requires less number of parts by mounting the transmitted light source 71*a* and the reflection light source 71*b* in the single light emitting element 71. The light emitting element 71 is arranged near the carrying path 11 on which the recording material 9 is carried. The light emitting element 71 is enabled to irradiate the first light and the second light toward the carrying path 11 at the same time. The wavelength of each of the first and the second lights of the respective preferred embodiments may be applied to the wavelength of each of the first and the second lights of the third preferred embodiment.

The transmitted light detecting element 72 is arranged to sandwich the carrying path 11 between the light emitting element 71 and itself. The transmitted light detecting element 72 faces the light emitting element 71. The transmitted light detecting element 72 is a light receiving element formed by a photodiode, for instance. The transmitted light detecting element 72 has a sensitivity to the first light irradiated from the transmitted light source 71*a*. The transmitted light detecting element 72 is a sensor that measures a light amount by receiving the first light. A filter 74 is provided on the surface of the transmitted light detecting element 72, for example. The filter 74 transmits only a wavelength component of the first light. The transmitted light detecting element 72 measures a light amount of the wavelength component of the first light that transmits the filter 74.

The reflection light detecting element 73 is provided adjacently to the light emitting element 71 and arranged oppositely to the transmitted light detecting element 72 across the carrying path 11. The reflection light detecting element 73 is also a light receiving element formed by a photodiode, for instance. The reflection light detecting element 73 has a sensitivity to the second light irradiated from the reflection light source 71*b*. The reflection light detecting element 73 is a sensor that measures a light amount by receiving a reflection light which is generated when the second light is reflected by the surface of the reference plate for reflection light 35 or the recording material 9. A filter 75 is provided on the surface of the reflection light detecting element 73, for example. The filter 75 transmits only a wavelength component of the second light. The reflection light detecting element 73 measures a light amount of the wavelength component of the second light that transmits the filter 75.

In the third preferred embodiment, the carrying path 11 is provided between the transmitted light detecting element 72 and the reflection light detecting element 73, and each of the transmitted light detecting element 72 and the reflection light detecting element 73 serves as the light detecting component 33 as explained in the first preferred embodiment.

The reference plate for reflection light 35 is the reflection plate to reflect the second light irradiated from the reflection light source 71*b* when the recording material 9 is not positioned on the carrying path 11. The reference plate for reflection light 35 enables a reflection light as a reference to enter into the reflection light detecting element 73. The reference plate for reflection light 35 is, for example, arranged in a frame shape surrounding a periphery of the transmitted light detecting element 72. However, this is given not for limitation. The reference plate for reflection light 35 may be arranged between the carrying path 11 and the transmitted light detecting element 72, and the transmitted light detecting element 72 may be arranged on a back side of the reference plate for reflection light 35. The reference plate for reflection light 35 only reflects the second light irradiated from the reflection light source 71*b*, and does not reflect the first light irradiated from the transmitted light source 71*a*.

For detecting the characteristic of the recording material 9, the recording material characteristic detecting device 30 having the above-described structure. The recording material characteristic detecting device 30, for example, turns on the transmitted light source 71*a* and the reflection light source 71*b* at the same time without having the recording material 9 on the carrying path 11, and measures the reference transmitted light amount and the reference reflection light amount at the same time. The recording material characteristic detecting device 30 then again turns on the transmitted light source 71*a* and the reflection light source 71*b* at the same time with having the recording material 9 positioned on the carrying path 11, and measures the recording material transmitted light amount and the recording material reflection light amount at the same time.

Figure 12A:
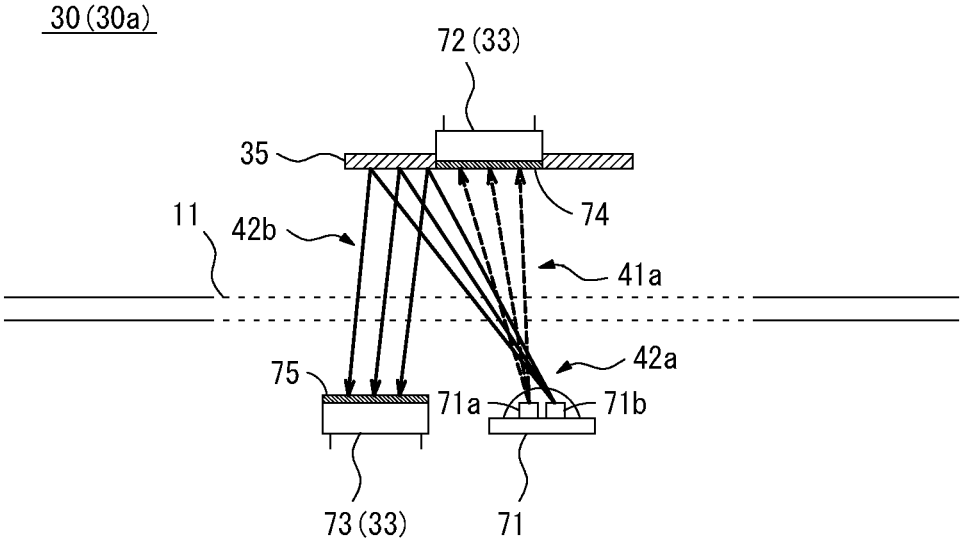
FIGS. 12A and 12B illustrate a concept of measurement carried out by the sensor unit of the recording material characteristic detecting device.
Figure 12B:
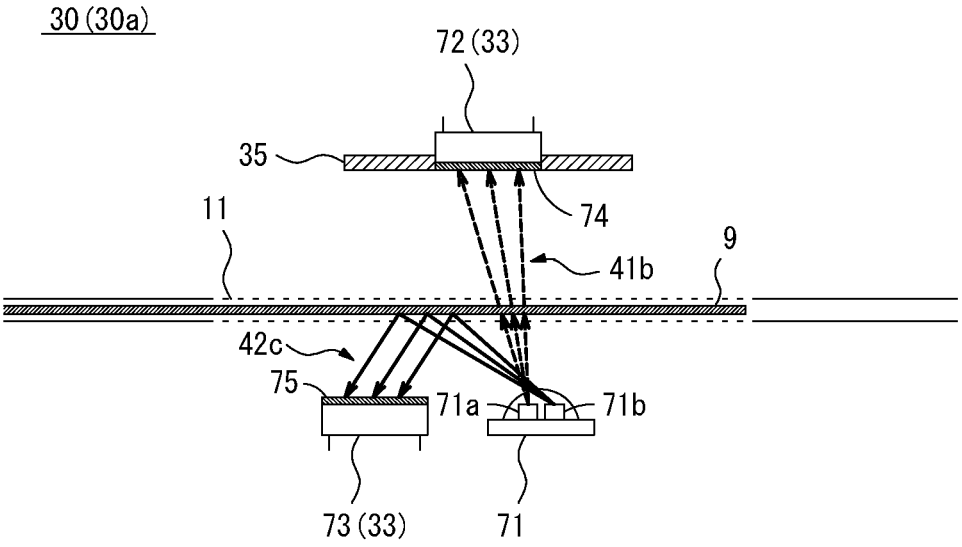

FIGS. 12A and 12B illustrate a concept of measurement carried out by the sensor unit 30*a*. As illustrated in FIG. 12A, for measuring the reference transmitted light amount and the reference reflection light amount at the same time, the recording material characteristic detecting device 30 turns on the transmitted light source 71*a* and the reflection light source 71*b* of the light emitting element 71 at the same time without having the recording material 9 on a measurement target position in the carrying path 11. The first light 41*a* irradiated from the transmitted light source 71*a* enters into the transmitted light detecting element 72. The transmitted light detecting element 72 measures the reference transmitted light amount based on the light amount of the first light 41*a* received from the transmitted light source 71*a*. The second light 42*a* irradiated from the reflection light source 71*b* is reflected by the reference plate for reflection light 35 arranged in the periphery of the transmitted light detecting element 72. The reflection light 42*b* of the second light 42*a* enters into the reflection light detecting element 73. The reflection light detecting element 73 measures the reference reflection light amount based on the light amount of the reflection light 42*b*. As described above, the reference transmitted light amount and the reference reflection light amount are measured at the same time so that the time required for the measurement can be shortened.

As illustrated in FIG. 12B, for measuring the recording material transmitted light amount and the recording material reflection light amount at the same time, the recording material characteristic detecting device 30 turns on again the transmitted light source 71*a* and the reflection light source 71*b* of the light emitting element 71 at the same time with having the recording material 9 on the measurement target position in the carrying path 11. The first light 41*a* irradiated from the transmitted light source 71*a* transmits the recording material 9, and the transmitted light 41*b* enters into the transmitted light detecting element 72. The transmitted light detecting element 72 measures the recording material transmitted light amount based on the light amount of the transmitted light 41*b*.

A part of the transmitted light 41*b* that transmits the recording material 9 sometimes reaches the reference plate for reflection light 35. The reference plate for reflection light 35 of the third preferred embodiment does not reflect the transmitted light 41*b* of the first light 41*a*. This prevents from generation of the irregular reflection of the transmitted light between the reference plate for reflection light 35 and the recording material 9. Moreover, the recording material transmitted light amount can be measured accurately by the transmitted light detecting element 72.

The second light 42*a* irradiated from the reflection light source 71*b* is reflected by the surface of the recording material 9, and becomes the reflection light 42*c* toward the reflection light detecting element 73. The reflection light detecting element 73 measures the recording material reflection light amount based on the light amount of the reflection light 42*c*.

As described above, the recording material transmitted light amount and the recording material reflection light amount are measured at the same time so that the time required for the measurement can be shortened. Moreover, the recording material transmitted light amount and the recording material reflection light amount are measured at the same time so that the recording material transmitted light amount and the recording material reflection light amount may be measured based on the same position of the recording material 9 set as the measurement target position. Especially even when the measurement is carried out during the carrying of the recording material 9, the recording material transmitted light amount and the recording material reflection light amount can be measured with targeting the same position of the recording material 9. Even if the recording material 9 is a patterned paper, for instance, the recording material transmitted light amount and the recording material reflection light amount measured with targeting the same position of the recording material 9 can be obtained.

In the third preferred embodiment, the transmitted light source 71*a* and the reflection light source 71*b* are mounted inside the single light emitting element 71. The two light sources may be formed as a separate light source. The structures and operations aside from ones described in the third preferred embodiment are the same as those described in the first preferred embodiment.

Fourth Preferred Embodiment

The fourth preferred embodiment of the present invention is explained next. In the above-described first to third preferred embodiments, a light having a certain single wavelength is applied as the first light emitted by the transmitted light source 31 or the transmitted light source 71*a*. A correlation between transmittance and basic weight of the recording material 9 varies in accordance with the wavelength of the first light. Sometimes higher correlation can be admitted in relation between the transmittance and the basic weight when the first light has a different wavelength rather than having the certain single wavelength. To be more specific, the wavelength which is admitted to have a high correlation between the transmittance and the basic weight can vary in accordance with the type of the recording material 9. If only the certain single wavelength is applied as the wavelength of the first light, the reliability for determining the basic weight may be reduced for some types of the recording material 9. According to the fourth preferred embodiment, two types of lights are used as the wavelength of the first light.

Figure 13:
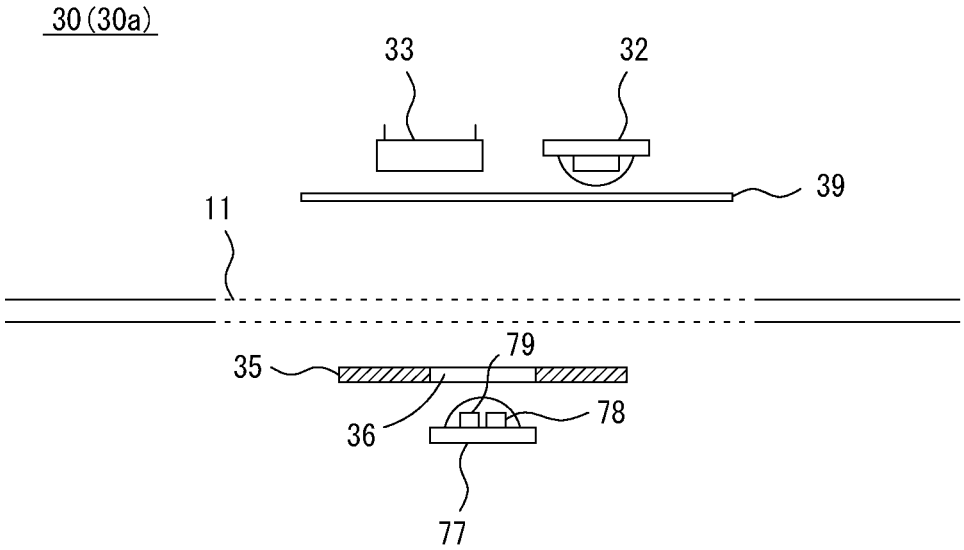
FIG. 13 illustrates an exemplary structure of the sensor unit of the recording material characteristic detecting device in which a fourth preferred embodiment may be practiced.
Figure 14A:
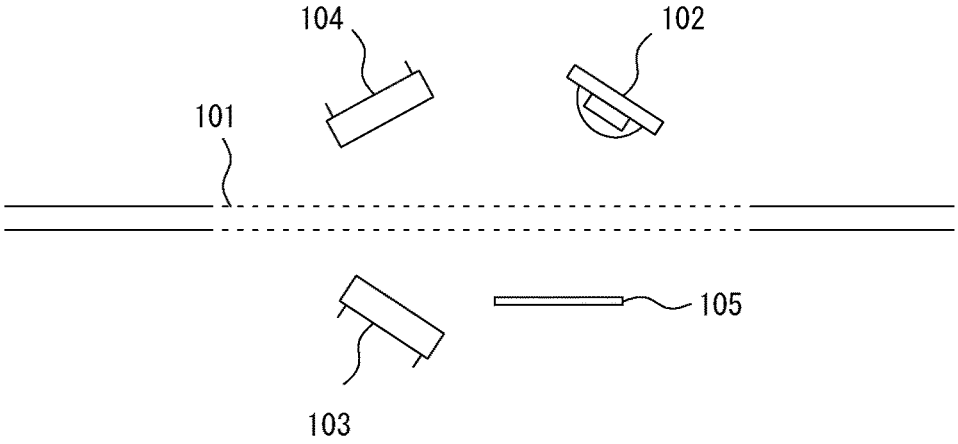
FIGS. 14A, 14B and 14C illustrate an exemplary structure of the conventional image forming device having the reflection board.
Figure 14B:
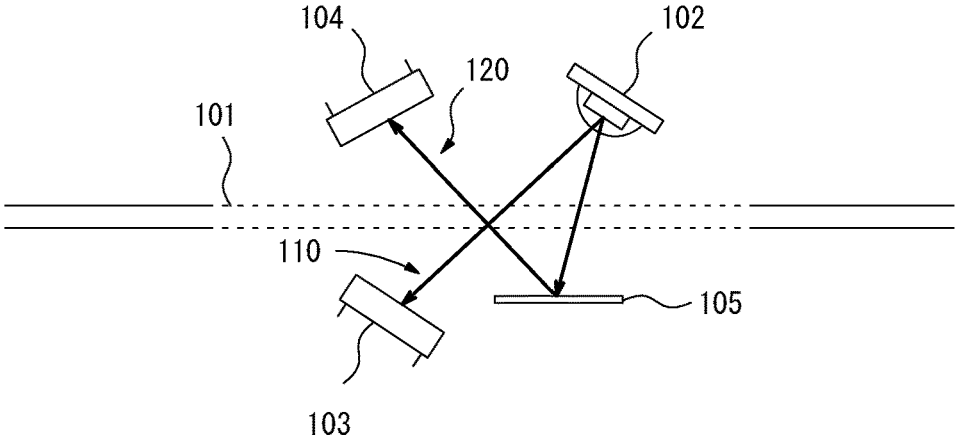
Figure 14C:
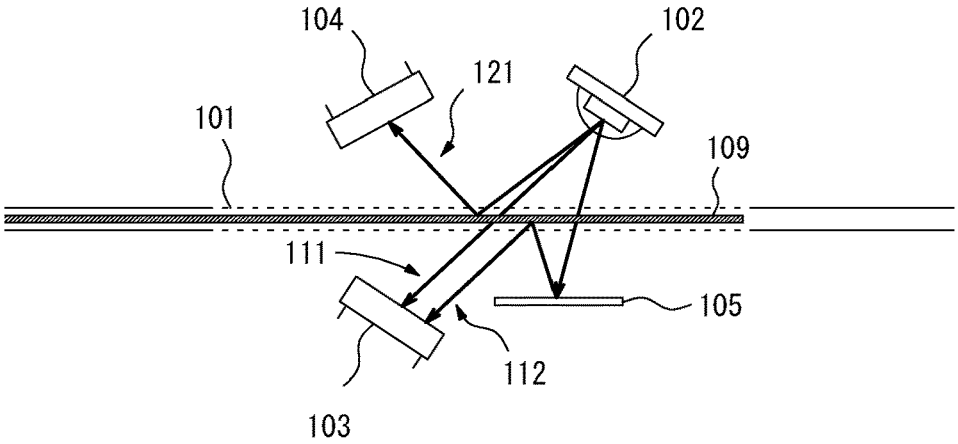

FIG. 13 illustrates an exemplary structure of the sensor unit 30*a* of the recording material characteristic detecting device 30 of the fourth preferred embodiment. The sensor unit 30*a* of FIG. 13 is provided with a light emitting element for transmitted light 77 instead of the transmitted light source 31, which is the difference from the sensor unit 30*a* of FIG. 2. [0121] As illustrated in FIG. 13, a first light source 78 and a second light source 79 are mounted inside the light emitting element for transmitted light 77. The first light source 78 emits a light having a first wavelength, and the second light source 79 emits a light having a second wavelength. The light emitting element for transmitted light 77 irradiates two types of lights having different wavelengths as the first light. The first light source 78 of the fourth preferred embodiment, for example, uses a light source that emits a near infrared light having a wavelength 750 to 1400 nm as the light of the first wavelength. The second light source 79 uses a light source that emits a blue light having a wavelength 450 to 495 nm as the light of the second wavelength.

The reflection light source 32 of the fourth preferred embodiment irradiates a light having a third wavelength which is different from any of the first or the second wavelength as the second light. The reflection light source 32, for example, uses a light source that emits a green light having a wavelength 495 to 570 nm as the second light.

For measuring the reference transmitted light amount and the recording material transmitted light amount, the recording material characteristic detecting device 30 turns on each of the first light source 78 and the second light source 79 separately. The recording material characteristic detecting device 30 measures the transmittance of the recording material 9 as a first transmittance which is obtained when the first light source 78 is turned on, and the transmittance of the recording material 9 as a second transmittance which is obtained when the second light source 79 is turned on. The recording material characteristic detecting device 30 determines which of the first and the second transmittances is applied based on the type of the recording material 9 determined by the type determining unit 57, and determines the basic weight of the recording material 9 using the applied transmittance. More specifically, the recording material characteristic detecting device 30 of the fourth preferred embodiment is enabled to determine the basic weight using the transmittance which is obtained when the light having a wavelength appropriate for the type of the recording material 9 is irradiated. Moreover, the recording material characteristic detecting device 30 is enabled to specify the high reliable basic weight based on the relation between the transmittance and the basic weight in which the high correlation can be admitted. Hence, the recording material characteristic detecting device 30 of the fourth preferred embodiment is enabled to obtain the characteristic of the recording material 9 in a high accuracy.

According to the fourth preferred embodiment, two light sources, the first light source 78 and the second light source 79, are mounted inside the single light emitting element for transmitted light 77. However, this is given not for limitation. The first light source 78 and the second light source 79 may be formed as the separate emitting element. The structures and operations aside from ones described in the fourth preferred embodiment are the same as those described in the first to third preferred embodiments.

Although the embodiments of the present invention have been described and illustrated in detail, it is clearly understood that the same is by way of illustration and example only and not limitation, the scope of the present invention should be interpreted by terms of the appended claims.

(Modifications)

While the preferred embodiments of the present invention have been described above, the present invention is not limited to the preferred embodiments. Various modifications may be applied to the present invention.

In the above-described preferred embodiments, for example, the image forming device 1 is constructed by a printer. However, this is given not for limitation. The image forming device 1 may be constructed by a device such as the MFP including multiple functions, and a printer function may be included as one of the multiple functions.

In the above-described preferred embodiments, when determining the type of the recording material 9 based on the reflectivity of the recording material 9, it is determined that the recording material 9 is which of the plain paper, the recycled paper and the coated paper. The types of the recording material 9 that can be determined are not only the plain paper, the recycled paper and the coated paper. The types including an embossed paper, an envelope and an OHP sheet, for example, may also be determined.

In the above-described preferred embodiments, the transmittance of the recording material 9 is calculated based on the reference transmitted light amount and the recording material transmitted light amount, and the reflectivity of the recording material 9 is calculated based on the reference reflection light amount and the recording material reflection light amount so that the characteristic of the recording material 9 is determined. However, this is given not for limitation A light emission intensity for emitting the transmitted light source 31, 71*a* or 78 and/or the reflection light source 32 or 71*b* may be controlled based on the reference transmitted light amount and/or the reference reflection light amount. A light amount at factory shipment may be stored as an initial transmitted light amount and an initial reflection light amount, for example. If there is a difference between the reference transmitted light amount and the reference reflection light amount measured for detecting the characteristic of the recording material 9 and the initial transmitted light amount and the initial reflection light amount, the light emission intensities of the transmitted light sources 31, 71*a* and 78 or the reflection light sources 32 and 71*b* are adjusted based on the difference. As a result, each of the transmitted light sources 31, 71*a* and 78 and the reflection light sources 32 and 71*b* may be enabled to emit light with the same intensity as one at factory shipment for measuring the recording material transmitted light amount and the recording material reflection light amount, so that the measurement does not get an effect of the time-dependent change.

What is claimed is:

1. A recording material characteristic detecting device that irradiates a first light having a first characteristic and a second light having a second characteristic to a sheet type recording material carried along a predetermined carrying path and detects a transmitted light generated when the first light transmits through the recording material and a reflection light generated when the second light is reflected by the recording material, and detects a characteristic of the recording material, the recording material characteristic detecting device comprises:

a reflection light source that irradiates the second light toward the carrying path;

a transmitted light source that irradiates the first light toward the carrying path;

a reference plate for reflection light arranged oppositely to the reflection light source across the carrying path to reflect the second light; and a light detector arranged oppositely to the reference plate for reflection light across the carrying path to detect at least a reflection light generated in response to reflection of the second light, wherein the reference plate for reflection light has a higher reflectivity for light having the second characteristic than for light having the first characteristic, and the reference plate is arranged such that light from the reflection light source that is reflected by the reference plate is reflected to the light detector.

2. The recording material characteristic detecting device according to claim 1, wherein the reflection light source irradiates a light of a wavelength different from the first light as the second light, and a reflectivity of the reference plate for reflection light to a wavelength of the second light is higher than a reflectivity of the reference plate for reflection light to a wavelength of the first light.

3. The recording material characteristic detecting device according to claim 1, wherein the reference plate for reflection light reflects the second light without reflecting the first light.

4. The recording material characteristic detecting device according to claim 1, further comprising:

a transmitted light source arranged oppositely to the reflection light source across the carrying path to reflect the second light, wherein the light detector is enabled to further detect the first light irradiated from the transmitted light source.

5. The recording material characteristic detecting device according to claim 4, wherein the reference plate for reflection light arranged between the transmitted light source and the carrying path comprises:

an aperture to lead the first light irradiated from the transmitted light source to the carrying path.

6. The recording material characteristic detecting device according to claim 5, wherein the reference plate for reflection light arranged on a surface opposite to the carrying path comprises:

a film that transmits the first light and reflects the second light, and the film is arranged to cover the aperture.

7. The recording material characteristic detecting device according to claim 1, further comprising:

a transmitted light source that irradiates the first light toward the carrying path; and a transmitted light detector arranged oppositely to the transmitted light source across the carrying path to detect the first light.

8. The recording material characteristic detecting device according to claim 7, wherein a single light emitting element mounts inside:

the transmitted light source; and the reflection light source.

9. The recording material characteristic detecting device according to claim 4, wherein the transmitted light source irradiates a light of a first wavelength and a light of a second wavelength as the first light, and the reflection light source irradiates a light of a third wavelength which is different from the first wavelength or the second wavelength as the second light.

10. The recording material characteristic detecting device according to claim 1, wherein the reflection light source is positioned separately from the carrying path by a predetermined space.

11. The recording material characteristic detecting device according to claim 1, further comprising:

a characteristic detector that detects the characteristic of the recording material based on both of:

a reference transmitted light amount and a reference reflection light amount detected in response to measurement of the first light and the reflection light of the second light without the recording material positioned on the carrying path, and a recording material transmitted light amount and a recording material reflection light amount detected in response to measurement of a transmitted light of the first light and the reflection light of the second light with the recording material positioned on the carrying path.

12. The recording material characteristic detecting device according to claim 11, wherein the characteristic detector comprises:

a type determinator that determines a type of the recording material based on the reference reflection light amount and the recording material reflection light amount; and a basic weight determininator that determines a basic weight corresponding to the type of the recording material which is determined, based on the reference transmitted light amount and the recording material transmitted light amount, by the type determinator.

13. An image forming device that carries a sheet type recording material along a predetermined carrying path and forms an image on the recording material, comprises:

a recording material characteristic detecting device according to claim 1, which is arranged in the carrying path; and a controller that controls operations to form the image on the recording material based on the characteristic of the recording material detected by the recording material characteristic detecting device.

14. The image forming device according to claim 13, wherein the controller adjusts a carrying speed to carry the recording material along the carrying path based on the characteristic of the recording material detected by the recording material characteristic detecting device.

15. The image forming device according to claim 14, further comprising:

a fixing unit that applies a heating and pressuring operation to the recording material to fix the image formed on the recording material to the recording material, wherein the controller adjusts the heating and pressuring operation performed by the fixer based on the characteristic of the recording material detected by the recording material characteristic detecting device.

* * * * *